US011721171B2

(12) United States Patent
Marks et al.

(10) Patent No.: US 11,721,171 B2
(45) Date of Patent: Aug. 8, 2023

(54) SYSTEMS AND METHODS FOR SHORT TERM PERSISTENCE BY UNLOCKING ADDITIONAL SYMBOL POSITIONS

(71) Applicant: Aristocrat Technologies, Inc., Las Vegas, NV (US)

(72) Inventors: Daniel Marks, Decatur, GA (US); Hua Xu, Marietta, GA (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 277 days.

(21) Appl. No.: 16/860,818

(22) Filed: Apr. 28, 2020

(65) Prior Publication Data

US 2021/0335097 A1 Oct. 28, 2021

(51) Int. Cl.
*G07F 17/34* (2006.01)
*G07F 17/32* (2006.01)

(52) U.S. Cl.
CPC ..... *G07F 17/3262* (2013.01); *G07F 17/3213* (2013.01); *G07F 17/34* (2013.01)

(58) Field of Classification Search
CPC ... G07F 17/3262; G07F 17/3213; G07F 17/34
USPC ..... 463/20
See application file for complete search history.

(56) References Cited

U.S. PATENT DOCUMENTS 6,997,805 B2 2/2006 Vancura
D611,957 S 3/2010 Fletcher
D655,710 S 3/2012 Inada
8,403,744 B2 3/2013 Walker
8,430,737 B2 4/2013 Saunders
8,696,438 B2 4/2014 Englman
9,177,447 B2 11/2015 Zoltewicz
D764,499 S 8/2016 Virk
D764,541 S 8/2016 Huang
D772,888 S 11/2016 Jon
D772,921 S 11/2016 Jewitt
D780,205 S 2/2017 Jensen
9,569,932 B2 2/2017 Nicely
(Continued)

OTHER PUBLICATIONS

Notice of Allowance dated May 31, 2022 for U.S. Appl. No. 29/732,902 (pp. 1-13).

(Continued)

*Primary Examiner* — Jay Trent Liddle
*Assistant Examiner* — Ryan Hsu
(74) *Attorney, Agent, or Firm* — Armstrong Teasdale LLP

(57) ABSTRACT

An electronic gaming machine includes a game controller configured to (i) display, (a) an initial game play area including a plurality of reels and (b) a bonus region, the initial game play area including a plurality of active symbol display positions, and the bonus region including a plurality of inactive symbol display positions, (ii) generate a first game outcome for a first base round based on a first output, (iii) in response to determining that at least one of the displayed symbols for the first game outcome is a trigger symbol, unlock at least one of the plurality of inactive symbol display positions in the bonus region, and (iv) after a plurality of base rounds of the base game, initiate a bonus game including activating all inactive symbol display positions that have been unlocked, the activating including expanding the initial game play area to include the activated symbol display positions.

20 Claims, 15 Drawing Sheets

(56) References Cited

U.S. PATENT DOCUMENTS

| | | | | |
|---|---|---|---|---|
| D797,121 | S | 9/2017 | Tegethoff | |
| D830,375 | S | 10/2018 | Phillips | |
| D839,304 | S | 1/2019 | Penacho | |
| 10,176,665 | B2 | 1/2019 | Hawkins | |
| D841,048 | S | 2/2019 | Penacho | |
| D842,327 | S | 3/2019 | Suslik | |
| D847,189 | S | 4/2019 | Suslik | |
| D847,848 | S | 5/2019 | Suslik | |
| 10,297,108 | B2 | 5/2019 | De Waal | |
| D865,805 | S | 11/2019 | Kim | |
| 10,490,020 | B2 | 11/2019 | Hawkins | |
| D870,138 | S | 12/2019 | Penacho | |
| D875,769 | S | 2/2020 | Penacho | |
| D900,130 | S | 10/2020 | Matos | |
| D900,859 | S | 11/2020 | Satterlie | |
| D922,400 | S | 6/2021 | Sahu | |
| D940,750 | S | 1/2022 | Kroon | |
| D952,646 | S | 5/2022 | Ludwick | |
| D961,613 | S | 8/2022 | Na | |
| 2009/0239631 | A1 | 9/2009 | Aoki | |
| 2010/0029381 | A1* | 2/2010 | Vancura | G07F 17/3244 463/30 |
| 2013/0217469 | A1 | 8/2013 | Fujisawa | |
| 2013/0225251 | A1 | 8/2013 | Baerlocher | |
| 2015/0234548 | A1 | 8/2015 | Pierre | |
| 2016/0358416 | A1 | 12/2016 | Kiely | |
| 2017/0110119 | A1 | 4/2017 | Hsu | |
| 2020/0111328 | A1* | 4/2020 | Bland | G07F 17/3213 |
| 2020/0129369 | A1 | 4/2020 | Pearce | |
| 2020/0250923 | A1* | 8/2020 | Ceniceroz | G07F 17/3267 |

OTHER PUBLICATIONS

"Lotus Flower slot machine, bonus" Apr. 22, 2019, YouTube, site visited May 13, 2022: https://www.youtube.com/watch?v=7JOvPDJQCy0 (Year: 2019).

"G2E 2021—Aristocrat (Ryan Scott) Product Demos" Oct. 6, 2021, /ouTube, site visited May 13, 2022: https://www.youtube.com /watch?v=51H3-cPgHoM&t=308s (Year: 2021).

Notice of Allowance dated Oct. 31, 2022 for U.S. Appl. No. 29/732,902 (pp. 1-8).

* cited by examiner

SYSTEMS AND METHODS FOR SHORT TERM PERSISTENCE BY UNLOCKING ADDITIONAL SYMBOL POSITIONS

TECHNICAL FIELD

The field of disclosure relates generally to electronic gaming, and more particularly, to systems and methods for short term persistence by unlocking additional symbol positions over a plurality of rounds of gameplay to create an expanded game play area.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

SUMMARY

In one aspect, an electronic gaming machine is provided. The electronic gaming machine includes at least one display device, a player input interface configured to receive a player input, and a game controller. The game controller is configured to execute instructions stored in a tangible, non-transitory, computer-readable storage medium, which, when executed by the game controller, cause the game controller to at least display, on the at least one display device, (i) an initial game play area including a plurality of reels and (ii) a bonus region positioned above the initial game play area. The initial game play area includes a plurality of active symbol display positions. The bonus region includes a plurality of inactive symbol display positions.

In response to receiving a player input, the instructions also cause the game controller to generate a first game outcome for a first base round of a base game based on a first output. The first game outcome includes a plurality of symbols on each of the plurality of reels for display on the initial game play area on the at least one display device. In response to determining that at least one of the displayed symbols for the first game outcome is a trigger symbol, the instructions also cause the game controller to unlock at least one of the plurality of inactive symbol display positions in the bonus region. In some embodiments, the appearance of a trigger symbol may cause the game controller to unlock two or more inactive symbol display positions on a single reel at once. The instructions also cause the game controller to, after a plurality of base rounds of the base game, initiate a bonus game including activating all inactive symbol display positions that have been unlocked. The activating includes expanding the initial game play area to include the activated symbol display positions, thereby creating an expanded game play area.

In another aspect, a computer-implemented method is provided. The method is implemented on an electronic gaming machine. The electronic gaming machine includes at least one display device, a player input interface, and a game controller. The method includes displaying, on the at least one display device, (i) an initial game play area including a plurality of reels and (ii) a bonus region positioned above the initial game play area. The initial game play area includes a plurality of active symbol display positions. The bonus region includes a plurality of inactive symbol display positions.

The method also includes in response to receiving a player input, generating a first game outcome for a first base round of a base game based on a first output. The first game outcome includes a plurality of symbols on each of the plurality of reels for display on the initial game play area on the at least one display device. The method also includes in response to determining that at least one of the displayed symbols for the first game outcome is a trigger symbol, unlocking at least one of the plurality of inactive symbol display positions in the bonus region. The method also includes, after a plurality of base rounds of the base game, initiating a bonus game including activating all inactive symbol display positions that have been unlocked. The activating includes expanding the initial game play area to include the activated symbol display positions, thereby creating an expanded game play area.

In yet another aspect, a gaming system is provided. The gaming system includes at least one gaming device. The at least one gaming device includes at least one display device. The gaming system also includes a server system communicatively coupled to the at least one gaming device. The server system includes a processor configured to execute instructions stored on a tangible, non-transitory, computer-readable storage medium. When executed by the processor, the instructions cause the processor to display, on the at least one display device, (i) an initial game play area including a plurality of reels and (ii) a bonus region positioned above the initial game play area. The initial game play area includes a plurality of active symbol display positions. The bonus region includes a plurality of inactive symbol display positions.

The instructions also cause the processor to in response to receiving a player input, generate a first game outcome for a first base round of a base game based on a first output. The first game outcome includes a plurality of symbols on each of the plurality of reels for display on the initial game play area on the at least one display device. The instructions also cause the processor to in response to determining that at least one of the displayed symbols for the first game outcome is a trigger symbol, unlock at least one of the plurality of inactive symbol display positions in the bonus region. The instructions also cause the processor to, after a plurality of base rounds of the base game, initiate a bonus game including activating all inactive symbol display positions that have been unlocked. The activating includes expanding the initial game play area to include the activated symbol display positions, thereby creating an expanded game play area.

DETAILED DESCRIPTION

Figure 1:
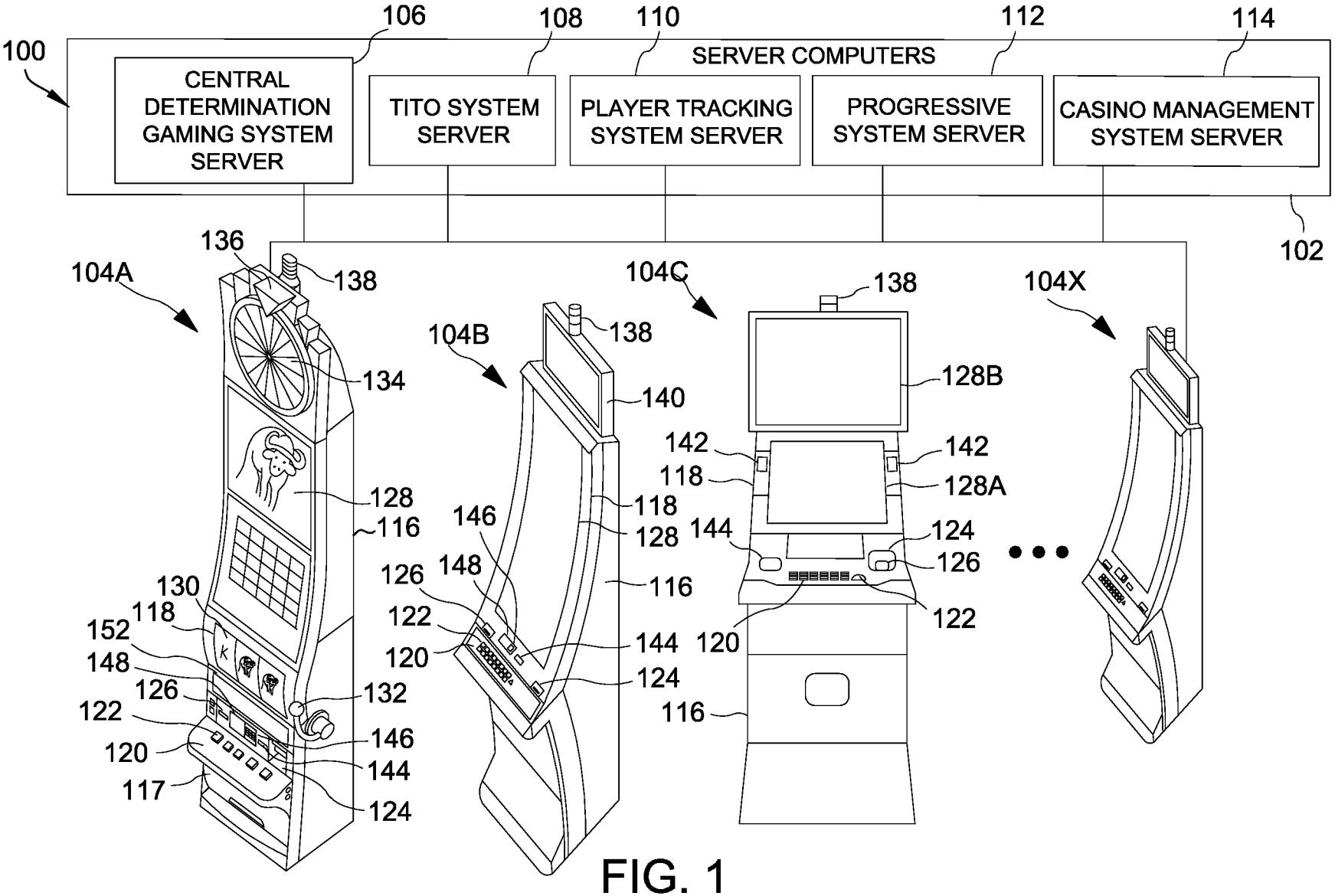
FIG. 1 is an exemplary diagram showing several EGMs networked with various gaming related servers.

Embodiments of the present disclosure provide systems and methods for short term persistence by unlocking additional symbol positions during an example wagering game. An electronic gaming machine provides a game that includes a collection game mode followed by a subsequent bonus game mode. The electronic gaming machine is configured to present trigger conditions, such as a trigger symbol or a combination of symbols, throughout the collection game mode to enable a player to unlock one or more inactive symbol display positions. The player collects the one or more unlocked, inactive symbol display positions over a number of collection rounds (N). The collected, unlocked symbol display positions are inactive (not available for gameplay) during the N-number of collection rounds. Rather, the unlocked symbol display positions become active symbol display positions configured to display symbols during the bonus game mode. In an example embodiment, the gaming device is configured to display one or more mystery symbols during the bonus game mode. Mystery symbols, which may be referred to herein as cash-on-reel symbols, are associated with cash values. In this example embodiment, mystery symbols do not appear during the N-number of collection rounds, but instead are configured to appear over a number of bonus rounds (M), thereby providing the player with more opportunities to win the M-number of bonus rounds.

In an example embodiment, the game includes an initial game play area and a bonus region. The initial game play area is defined by a plurality of active symbol display positions that are available for gameplay in both the collection game mode and in the bonus game mode. The bonus region is defined by a plurality of inactive symbol display positions that are not available for gameplay in the collection game mode. Rather, inactive symbol display positions that have been unlocked during the collection game mode are available for gameplay during the bonus game mode. In an example embodiment, the unlocked, inactive symbol display positions become active symbol display positions in the bonus game mode. These active symbol display positions as well as the active symbol display positions of the initial game play area define an expanded game play area available for gameplay in the bonus game mode. In one example embodiment, the game includes seven collection rounds, i.e., game plays or spins in which collection occurs, followed by one bonus round of gameplay. If a trigger condition is satisfied during the play of the collection rounds, such as a trigger symbol or a combination of symbols appearing on the reels of the initial game play area, one or more inactive symbol display positions located in the bonus region are unlocked. In various embodiments, a wager is required to play each of the N collection rounds as well as each of the M bonus rounds. In certain embodiments, the wager amount is fixed for each of these plays. In various embodiments, a wager is only required to play each of the N collection rounds and no wager is required to play each of the M bonus rounds. In certain embodiments, a wager amount may be collected prior to the play of the N collection rounds and M bonus rounds, where the wager amount is based on individual wager amounts for the N collection rounds and the M bonus rounds.

In an example embodiment, the electronic gaming machine selects cash-on-reel symbols for display on the reels only during the M-number of bonus rounds. Accordingly, a player has an incentive to unlock as many inactive symbol display positions as possible during the N-number of collection rounds so that there are more opportunities for one or more cash-on-reel symbols to appear in the active symbol display positions. In an example embodiment, the electronic gaming machine selects which inactive symbol display position(s) to unlock based on the reel(s) associated with the trigger condition. For example, if a trigger symbol is displayed in an active symbol display position of a first reel, the electronic gaming machine unlocks an inactive symbol display position associated with the first reel.

In an example embodiment, over the seven collection rounds, the player accumulates unlocked, inactive symbol display positions, which are associated with one or more respective reels. During the eighth round of gameplay (the bonus round), the unlocked, inactive symbol display positions are activated, and become active symbol display positions available for gameplay during the bonus game mode. During the bonus game mode, the active symbol display positions of the bonus region and the active symbol display positions of the initial game play area define an enhanced matrix (e.g., an expanded game play area) for gameplay over the M-number of bonus rounds. During the bonus game mode, symbols displayed in the expanded game play area are evaluated for purposes of Reel Power evaluation. Accordingly, the player is awarded any cash value associated with one or more displayed cash-on-reel symbols in addition to any Reel Power wins.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a web site maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
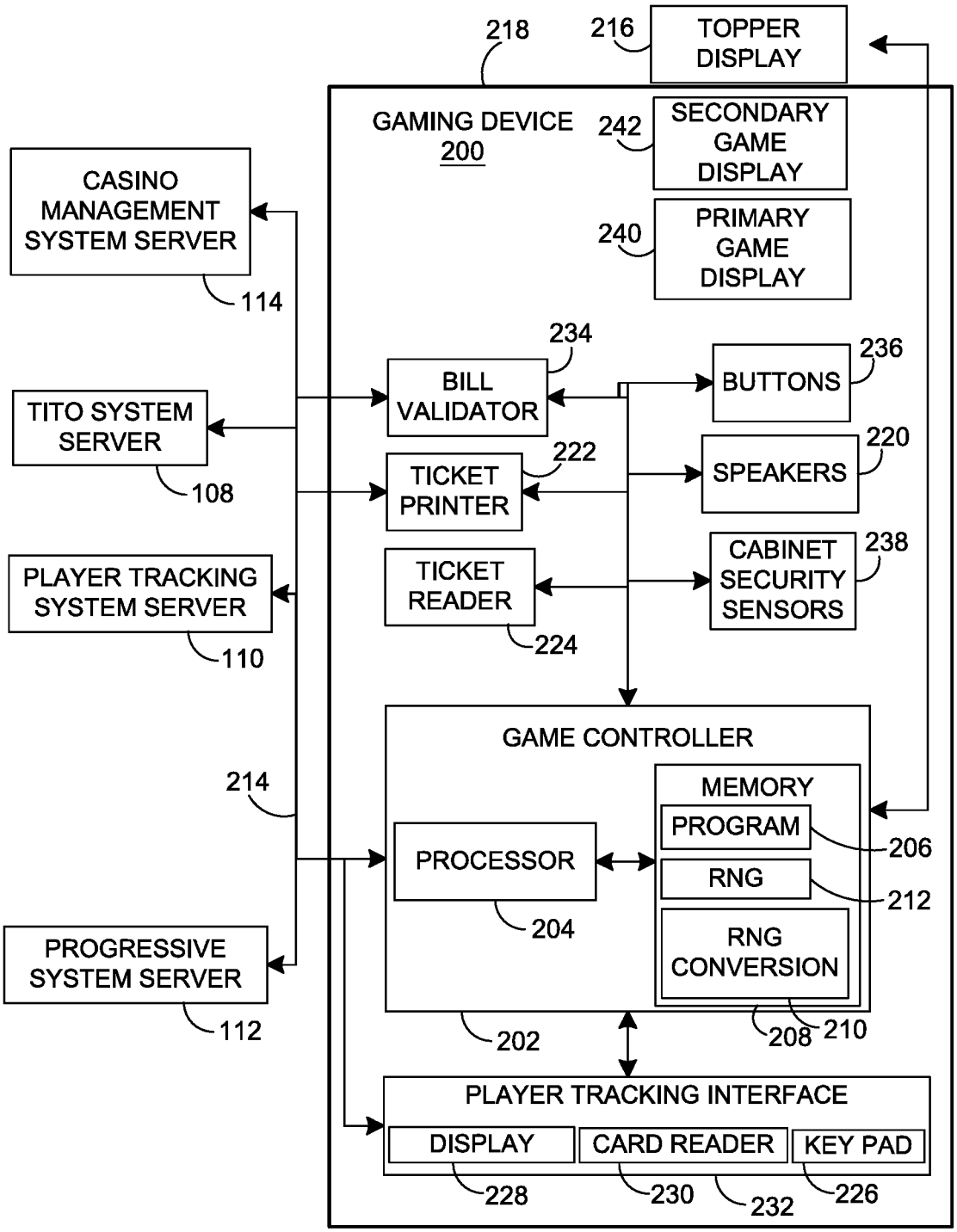
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 154 which opens to provide access to the interior of the gaming device 104B. The main or service door 154 is typically used by service personnel to refill the ticket-out printer 126 and collect bills and tickets inserted into the bill validator 124. The main or service door 154 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. As shown in FIG. 2, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2 illustrates that game controller 202 includes a single processor 204, game controller 202 is not limited to this representation and instead can include multiple processors 204 (e.g., two or more processors).

FIG. 2 illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2 illustrates that game controller 202 includes a single memory 208, game controller 202 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be setup to generate one or more game instances based on instructions and/or data that gaming device 200 exchange with one or more remote gaming devices, such as a central determination gaming system server 106 (not shown in FIG. 2 but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more embodiments, RNG 212 could be one of a set of RNGs operating on gaming device 200. Game developers could vary the degree of true randomness for each RNG (e.g., pseudorandom) and utilize specific RNGs depending on game requirements.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). FIG. 2 illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2 also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Although FIGS. 1 and 2 illustrates specific embodiments of a gaming device (e.g., gaming devices 104A-104X and 200), the disclosure is not limited to those embodiments shown in FIGS. 1 and 2. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards. Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface). Gaming devices 104A-104X and 200 may also include other processors that are not separately shown. Using FIG. 2 as an example, gaming device 200 could include display controllers (not shown in FIG. 2) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 3:
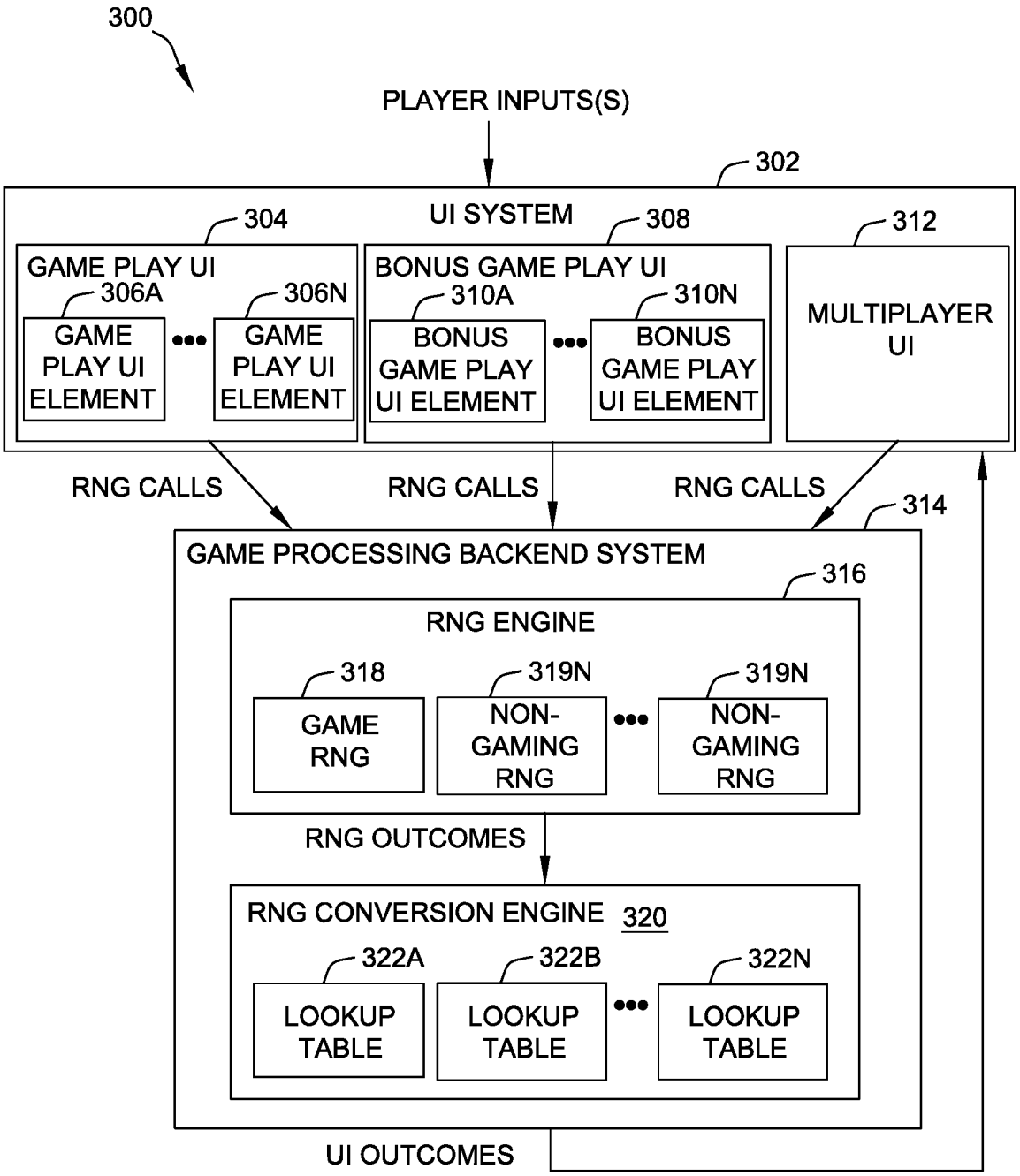
FIG. 3 illustrates, in block diagram form, an embodiment of a game processing architecture that implements a game processing pipeline for the play of a game in accordance with various embodiments described herein.

FIG. 3 illustrates, in block diagram form, an embodiment of a game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 304, and one or more multiplayer UIs 306, where each UI type includes one or more mechanical UIs and/or graphical UIs (GUIs). In other words, game play UI 304, bonus game play UI 304, and the multiplayer UI 304 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from to the bonus game play UI elements 310A-310N.

FIG. 3 also illustrates that UI system 302 could include a multiplayer UI 312 purposed for game play that differ or is separate from the typical base game. For example, multiplayer UI 302 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator (PRNG) (e.g., Fortuna PRNG) that securely produces random numbers for one or more game features. To generate random numbers, gaming RNG 318 could collect random data from various sources of entropy, such as from an operating system (OS), and/or a hardware based RNG (not shown in FIG. 3). Alternatively, non-gaming RNGs 319A-319N may not be cryptographically secure and/or be computational less expensive. Non-gaming RNGS 319A-319N can, thus, be used to generate outcomes for non-gaming purposes. As an example, non-gaming RNGs 319A-319N can generate random numbers for such as generating random messages that appear on the gaming device. The RNG conversion engine 320 processes each RNG outcome from RNG engine 316 and converts the RNG outcome to a UI outcome that is feedback to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome to the game outcome controls the frequency in hitting certain prize payout amounts.

Different lookup tables could be utilized depending on the different game modes. For example, the example reel-based game described herein includes a collection game mode (N-number of collection rounds) and a bonus game mode (M-number of bonus rounds). In an example embodiment, a player "collects" (accumulates) one or more inactive symbol display positions 420 (shown in FIG. 4) over the N-number of collection rounds for play during the M-number of bonus rounds. The player collects one or more inactive symbol display positions 420 when a trigger condition is met, such as the display of a trigger symbol or a combination of symbols in initial game play area 402 (shown in FIG. 4). For example, if the display of a certain trigger symbol or a combination of symbols unlocks one or more inactive symbol display positions, a lookup table associated with the trigger symbol or combination of symbols may be referenced to determine not only the number of inactive symbol display positions 420 to unlock, but also to determine which inactive symbol display position 420 to unlock. In addition, one or more look up tables may be associated with the collection game mode and the bonus game mode to determine how to populate the symbol display positions (e.g., to prevent having too many or too little of the same symbols on a play area).

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to the updating the appropriate UI, the player may subsequently provide additional player inputs to initiate a subsequent game instance that progresses through the game processing pipeline.

Throughout this specification and in the claims, the terms "collection game mode," "base game mode," "collecting game session," "primary game," "collection rounds," "base game rounds" correspond to a designated number of rounds (N) of gameplay where a player is presented the opportunity to unlock one or more inactive symbol display positions for gameplay in subsequent bonus rounds (M) of gameplay. The terms "bonus game mode," "bonus game," "secondary game," "bonus game session," and "bonus rounds" refer generally to a number of additional rounds (M) of gameplay where a player can utilize the unlocked inactive symbol display positions accumulated over the previous collection rounds of gameplay. The example reel-based game described herein may be initiated in response to a wager or credit being received by or transferred to gaming device 200 (shown in FIG. 2). The example game may also be initiated by other game events including, for example, a player selecting a "spin" button, a start button, a deal button, or any other such input selector designated for initiating a game session.

Figure 4:
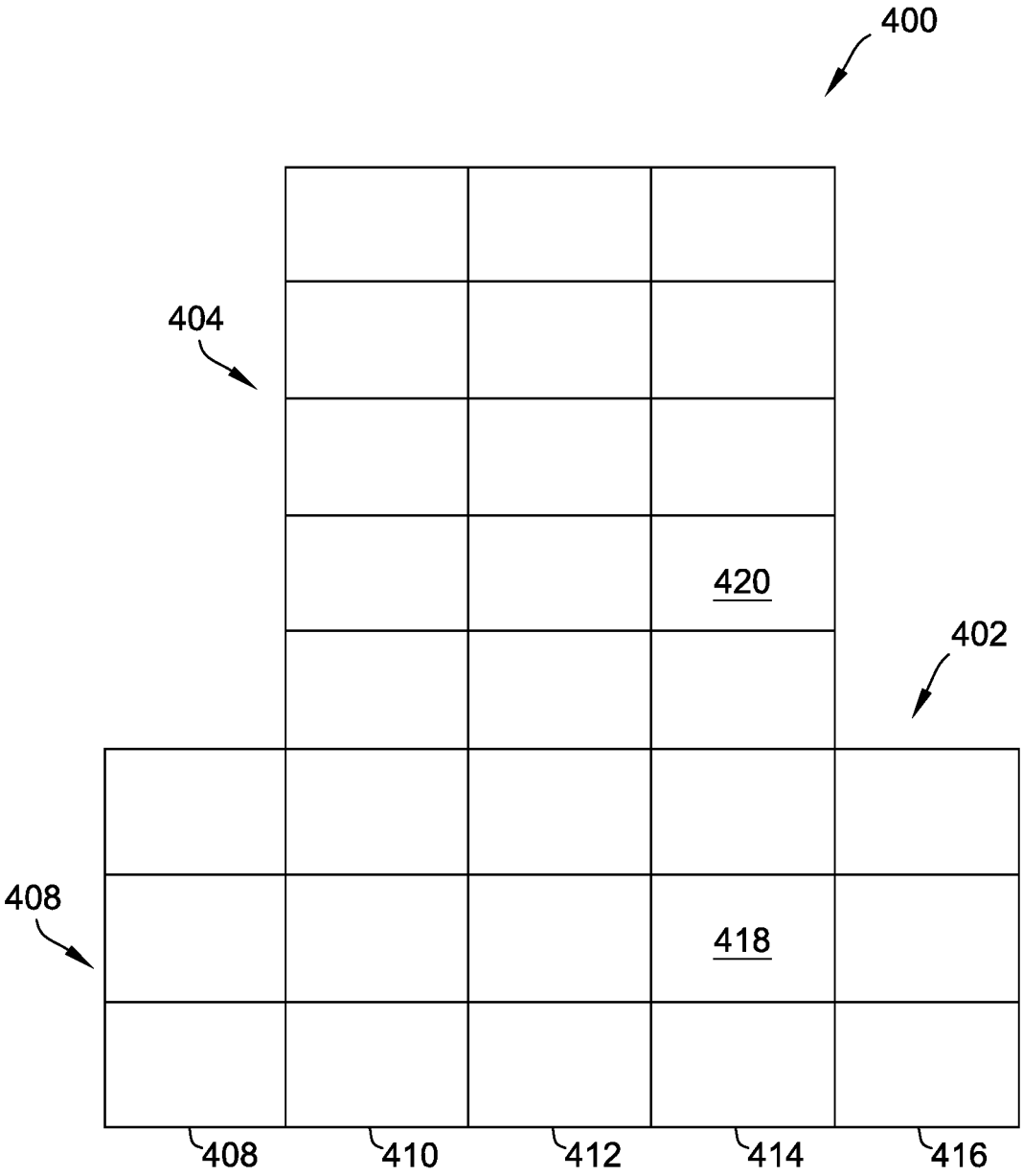
FIG. 4 is a diagram illustrating an initial configuration of a play area of an example reel-based game.

FIG. 4 illustrates an empty play area 400 for an example reel-based game provided by the gaming device 200 of FIG. 2 using the game processing architecture 300 of FIG. 3. In an example embodiment, play area 400 is represented as including an initial game play area 402 and a bonus region 404. In some embodiments, play area 400 may be presented by one or more EGMs 104A-104X (shown in FIG. 1) or the gaming device 200 (shown in FIG. 2) when a player initiates play of the base game. Initial game play area 402 includes a plurality of reels 406 that may spin and stop (e.g., with physical reels) or may be simulated to spin and stop (e.g., with virtual reels) in response to a player submitting a wager and initiating the base game.

In an example embodiment, reels 406 include a first reel 408, a second reel 410, a third reel 412, a fourth reel 414, and a fifth reel 416. However, any suitable number of reels, such as one reel to reels numbering greater than five reels, may be implemented on a variety of embodiments. Each reel 408-416 includes a plurality of active symbol display positions 418 which, together, define a matrix of active symbol display positions (e.g., represented as initial game play area 402). Further, each reel 408-416 is configured to display a certain number of symbols. Each active symbol display position 418 of each reel 408-416 may also include a symbol. In an example embodiment, each reel 408-416 includes three active symbol display positions 418, and each have similar dimensions. However, each reel 408-416 may display any suitable number of active symbol display positions 418.

Reels 408-416 may include simulated or "virtual" reels generated and displayed by one or more processors 204 (such as processors of game controller 202) on any game display, such as primary game display 240, secondary game display 242, topper display 216, player tracking interface display 228, and/or any other suitable display device. In other embodiments, reels 408-416 may include one or more physical reels (e.g., mechanical reels controlled by stepper motors) having a display element, such as a liquid crystal display (LCD), capable of displaying one or more symbols during gameplay. In other embodiments, reels 406 may include a plurality of mechanical reels overlaid by an LCD panel.

In FIG. 4, five inactive symbol display positions 420 are associated with each of second reel 410, third reel 412, and fourth reel 414. However, any suitable number of inactive symbol display positions 420 may be associated with one or more reels 406. In various embodiments, one or more inactive symbol display positions 420 are associated with first reel 408 and/or fifth reel 416. In an example embodiment, the plurality of inactive symbol display positions 420 are in a locked state. One or more inactive symbol display positions 420 of bonus region 404 transition from the locked state to an unlocked state when a trigger condition is met, such as a symbol or a combination of symbols being displayed on initial game play area 402 during each collection round of gameplay. When an inactive symbol display position 420 is unlocked, the unlocked, inactive symbol display position is not available for gameplay during the collection game mode. Rather the unlocked, inactive symbol display position becomes an active symbol display position available for gameplay during the bonus game mode. In certain embodiments, game controller 200 restricts inactive symbol display positions 420 to a subset of reels 408-416.

A "trigger condition," in an example embodiment, may refer to the appearance of a specific trigger symbol or a combination of symbols configured to unlock one or more inactive symbol display positions 420 of bonus region 404 when displayed in initial game play area 402. In an example embodiment, trigger symbols are configured to only appear in active symbol display positions 418 of initial game play area 402 during the N-number of collection rounds, so as to provide the player an opportunity to unlock as many inactive symbol display positions 420 as possible for gameplay during the M-number of bonus rounds.

A "prize" symbol, which may be referred to herein as "cash-on-reel" symbols and "mystery" symbols, may refer to any symbol having a prize shown in the symbol (e.g., a displayed credit award amount or a progressive jackpot value). A player is awarded any credit value or cash value shown on the prize symbol. In an example embodiment, wins that include the prize symbol(s) with identified awards will award the prize shown on the prize symbol in addition to the normal Reel Power pay for that symbol combination (e.g., an "of-a-kind" win). In an example embodiment, gaming device 200 is configured to select mystery symbols 1304 for display in expanded game play area 1302 of active symbol display positions during the M-number of bonus rounds (the bonus game mode) (both shown in FIG. 13). Accordingly, a player has an incentive to unlock as many inactive symbol display positions 420 as possible during the N-number of collection rounds (the collection game mode) to increase the chances of one or more mystery symbols appearing in the bonus game mode.

A "scatter" symbol, in an example embodiment is configured to unlock scatter features when a certain number of the same scatter symbol appears on play area 400 during a single gameplay (e.g., during a single spin). A variety of scatter symbols may be displayed on play area 400, including "free games" symbols (e.g., indicating a free play). In an example embodiment, the appearance of three or more of the same type of scatter symbol during a single play unlocks the associated scatter feature. For example, if three "free games" symbols are displayed on play area 400, the player unlocks a free spin.

As used herein, a "standard" symbol may refer to any symbol that is not a prize symbol or scatter symbol. As used herein, a "wild" symbol may refer to any symbol capable of substituting (e.g., on a line win or ways win) for another standard symbol. In an example embodiment, active symbol display positions are configured to display one of a prize symbol, scatter symbol, standard symbol, and wild symbol during M-number of bonus rounds.

In an example embodiment, gaming device 200 is configured to enable the player to accumulate unlocked, inactive symbol display positions over a number of collection rounds (N). The number of collection rounds may be (a) randomly determined; (b) predetermined; (c) determined based on a wager amount and/or level; (d) centrally determined; (e) determined based on a generated symbol or symbol combinations; (f) determined based on player selection; (g) determined based on player skill; (h) determined based on a side wager or ante bet; (i) determined based on a status of the player; (j) determined as a combination of two or more determinations disclosed herein. The collected inactive, unlocked symbol display positions become active (are activated) for play during a number of bonus rounds (M). The number of bonus rounds may be (a) randomly determined; (b) predetermined; (c) determined based on a wager amount and/or level; (d) centrally determined; (e) determined based on a generated symbol or symbol combinations; (f) determined based on player selection; (g) determined based on player skill; (h) determined based on a side wager or ante bet; (i) determined based on a status of the player; (j) determined as a combination of two or more determinations disclosed herein. During each of the bonus rounds, the activated symbol display positions of bonus region 404 and the symbol display positions 418 of initial game play area 402 define an expanded game play area of active symbol display positions (shown in FIG. 13) for gameplay during the M-number of bonus rounds, thereby increasing the player's chances of winning awards, such as cash values and/or credit awards.

The embodiments of the present disclosure provide a specific improvement to the technology of electronic gaming and electronic gaming machines. In particular, the embodiments described herein provide an improved user interface for electronic devices by (i) unlocking one or more inactive symbol display positions in the collection game mode, and (ii) activating all the unlocked, inactive symbol display positions in the bonus game mode, thereby creating an expanded game play area including the activated symbol display positions for gameplay during the bonus game mode. The expanded game play area provides more opportunities for winning combination of symbols to be displayed and/or for one or more cash-on-reel symbols to be displayed during the bonus game mode, thereby (i) increasing the probability of winning an actual award amount and (ii) increasing player excitement and engagement with gaming machines, as the number of symbol display positions available for gameplay increases. This also provides the player the ability to create equity in game play, as the unlocked positions are not in play until the play of the bonus mode. A player may feel that they need to complete the collection stage completely and play out the bonus stage before ending their gaming session. Further, rules associated with detecting trigger conditions may be stored in a database to quickly detect trigger conditions. Rules associated with determining which inactive symbol display position to unlock, and/or activating the unlocked, inactive symbol display positions may also be stored in the database.

In an example embodiment, a player may place a wager using, for example, a "spin" or "play" button. In response to a player wager, reels 406 are simulated to spin and stop, whereby symbols from reels 406 may be displayed in a plurality of active symbol display positions of play area 402 (e.g., as determined by the RNG output of the game processing backend system 314 of gaming device 200). In example embodiments, symbols in active symbol display positions are evaluated from left to right as a ways evaluation (e.g., a "Reel Power" evaluation). The example reel-based game described herein includes a collection game mode (N-number of collection rounds) and a bonus game mode (M-number of bonus rounds). In an example embodiment, a player "collects" (accumulates) one or more inactive symbol display positions 420 during the N-number of collection rounds for play during the M-number of bonus rounds. After each of the N-number of collection rounds, gaming device 200 evaluates the spin result displayed in initial game play area 402 to identify winning combinations of symbols.

After the N-number of collection rounds, the one or more unlocked, inactive symbol display positions collected during the N-number of collection rounds become active symbol display positions available for gameplay. During each of the M-number of bonus rounds, the active symbol display positions of the bonus region 404 as well as the plurality of active symbol display positions 418 of initial game play area 402 are configured to display symbols. After each of the M-number of bonus rounds, gaming device 200 evaluates the spin result displayed in play area 400 to identify winning combinations of symbols. A pay table (e.g., a pay table stored in memory 208) may be referenced to identify a payout or award based upon an identified winning combination of symbols. In various embodiments, an award may be multiplied or increased by a multiplication factor as well.

As shown in FIGS. 5-13, gaming device 200 may display five reels (reels 408-416), each having three active symbol display positions 418, for a total of fifteen active symbol display positions available for gameplay in the collection game mode (N-number of collection rounds). The fifteen active symbol display positions are represented as initial game play area 402. In an example embodiment, five inactive symbol display positions 420 are displayed above three of the five reels (second reel 410, third reel 412, and fourth reel 414, as shown in FIG. 4), for a total of fifteen inactive symbol display positions which are not available for gameplay in the collection game mode. The inactive symbol display positions 420 are represented as bonus region 404 positioned above initial game play area 402.

Figure 5:
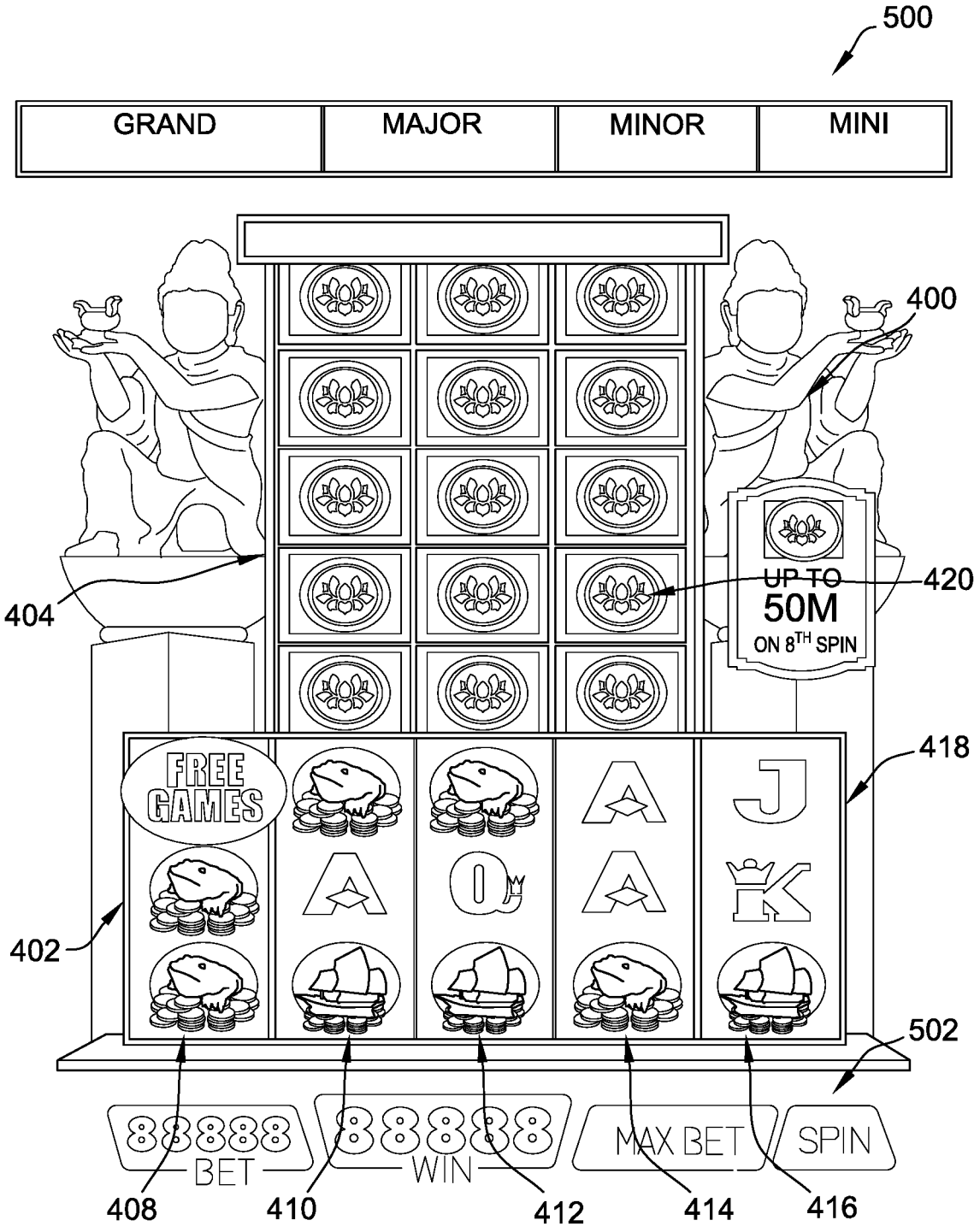
FIG. 5 illustrates an example screenshot of an example display of the play area prior to a round of gameplay in a collection game mode of the example game.

FIG. 5 illustrates an example display 500 on initial game play area 402 prior to a round of gameplay in the collection game mode. In an example embodiment, a player selects a spin button 502 to initiate a round of gameplay. During each collection round, each reel 408-416 may be simulated to spin and stop to display a subset of the symbols of each reel 408-416 in initial game play area 402. One or more random numbers from a random number generator, such as RNG 318 may be used to determine stop positions of each reel 408-416. During the collection game mode, inactive symbol display positions 420 are not activated for gameplay. In an example embodiment, a trigger condition, such as the appearance of one or more trigger symbols (or a combination of symbols) in active symbol display positions 418 of initial game play area 402, causes the gaming device 200 to unlock one or more inactive symbol display positions 420 in bonus region 404. In certain embodiments, gaming device 200 restricts inactive symbol display positions 420 of bonus region 404 to a subset of reels 408-416.

Gaming device 200 evaluates the spin result to determine if a trigger condition is met (e.g., the appearance of a trigger symbol or a combination of symbols). If the trigger condition is met, then the gaming device 200 unlocks a corresponding inactive symbol display position 420, and the corresponding unlocked, inactive symbol display position is added to the associated reel. Gaming device 200 also evaluates the game outcome after each round of gameplay to identify any symbols or combination of symbols associated with an award, such as a credit award or a cash value award, and to assign a corresponding award based upon the symbol evaluation of reels 408-416. In certain embodiments, the trigger symbol or combination of symbols indicates a reel, such as a reel number, with which it is associated with. In these embodiments, gaming device 200 unlocks a corresponding inactive symbol display position 420 associated with the indicated reel. In some embodiments, the trigger symbol or combination of symbol indicates a quantity of display positions 420 on one reel or more than one reel to unlock. In some embodiments, gaming device 200 unlocks two or more inactive symbol display positions 420 on a single reel at once in response to the appearance of a trigger symbol or a combination of symbols.

Figure 11:
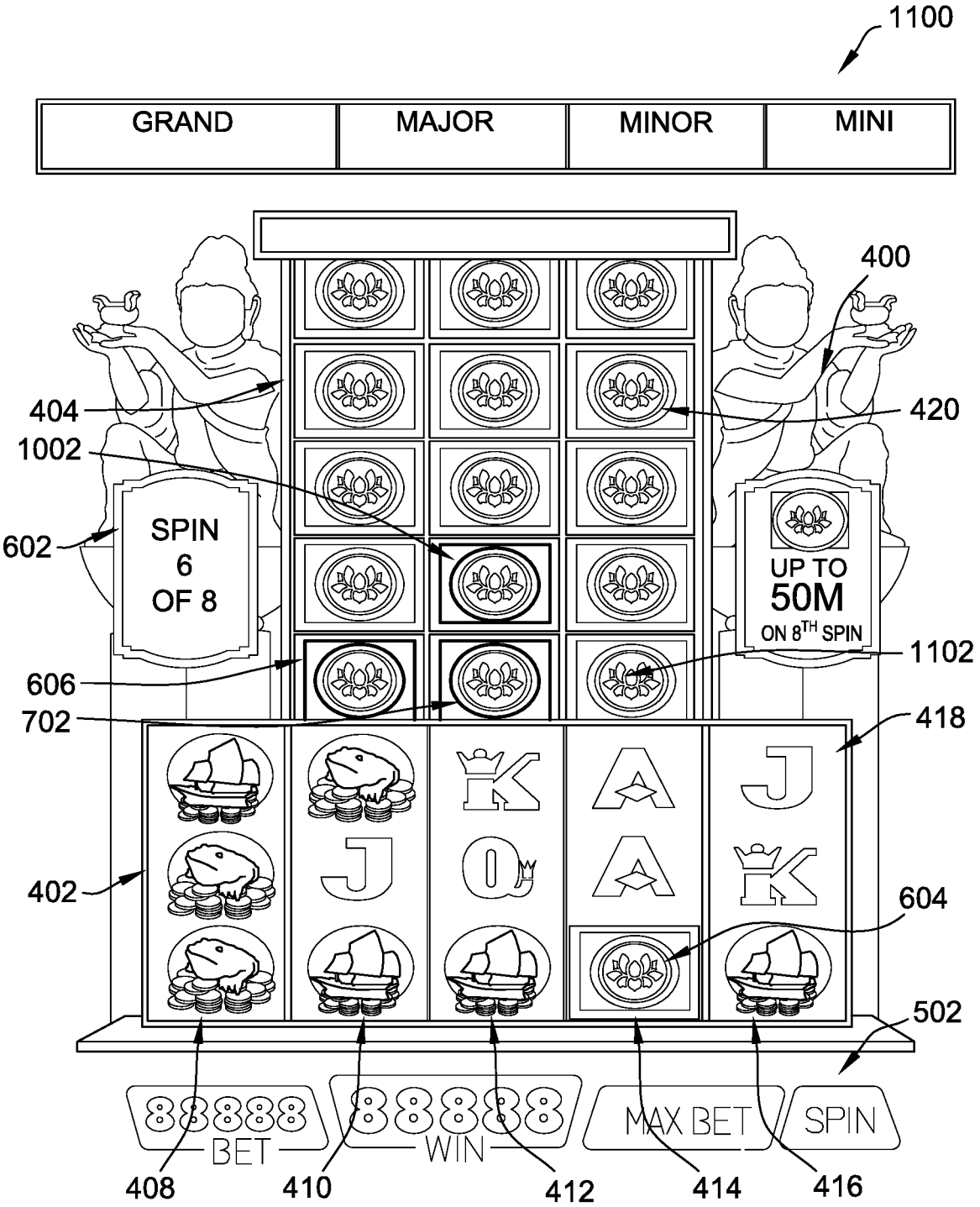
FIG. 11 illustrates an example screenshot of a sixth collection round of gameplay of the example game.
Figure 12:
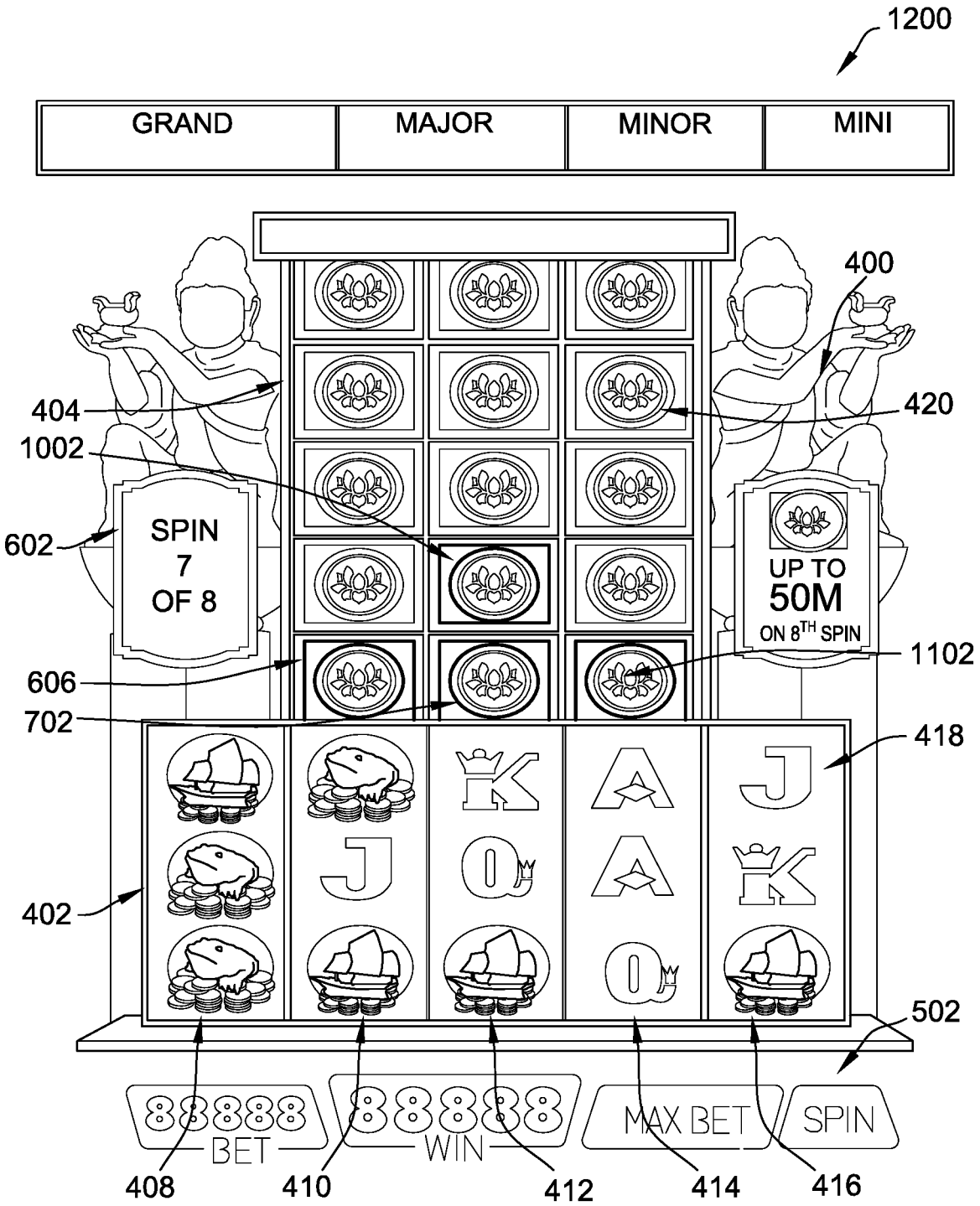
FIG. 12 illustrates an example screenshot of a seventh collection round of gameplay of the example game.
Figure 13:
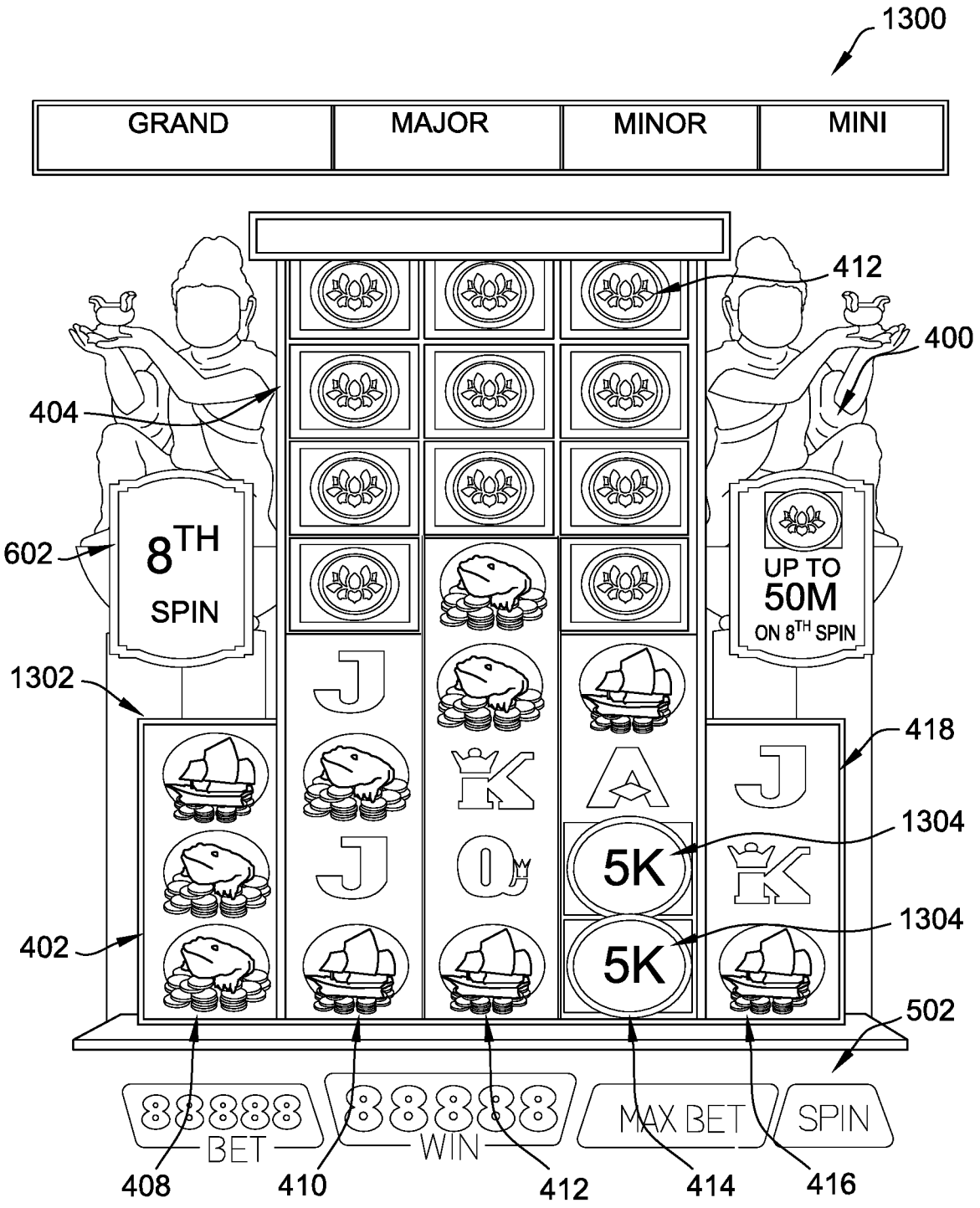
FIG. 13 illustrates an example screenshot of a bonus round of gameplay of the example game.

FIGS. 6-13, as described below, illustrate example spin results 600-1300 during consecutive rounds of gameplay of the example wagering game. In particular, FIGS. 6-12 illustrate rounds of gameplay in the collection game mode, and FIG. 13 illustrates a round of gameplay in the bonus game mode. In an example embodiment, the collection game mode includes seven collection rounds of gameplay, and the bonus game mode includes one bonus round of gameplay. However, any suitable number of collection rounds, such as one round to more than seven rounds may be implemented on a variety of embodiments. Additionally or alternatively, any suitable number of bonus rounds, such as greater than one round, may be implemented on a variety of embodiments. The collection game mode is initiated in response to a player wager. Reels 408-416 are simulated to spin and stop, whereby symbols from reels 408-416 may be displayed in a plurality of active symbol display positions 418 of initial game play area 402 (e.g., as determined by the RNG output of the game processing backend system 314 of gaming device 200).

Figure 6:
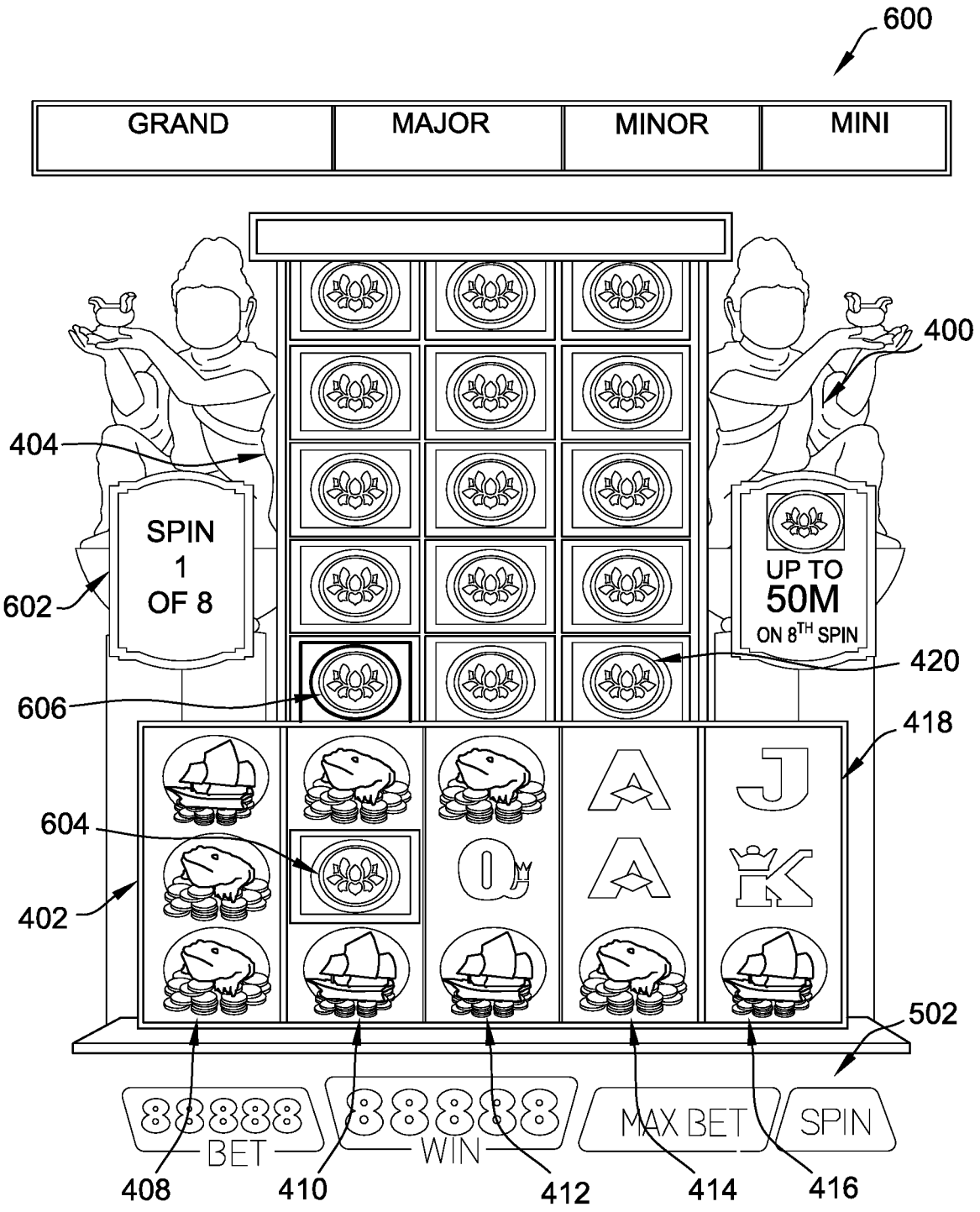
FIG. 6 illustrates an example screenshot of a first collection round of gameplay of the example game.

FIG. 6 illustrates an example spin result 600 on play area 400 after a first round of gameplay. Spin indicator 602 displays the current round of gameplay of a total number of available rounds ("Spin 1 of 8"). As shown in FIGS. 6-13, the total number of rounds available is eight rounds of gameplay, of which seven are collection rounds and one is a bonus round. In various embodiments, spin indicator 602 may be associated with a specific color to indicate whether the current round of gameplay is a collection round or a bonus round. For example, during collection rounds, the spin indicator 602 may be a blue color. During bonus rounds, the spin indicator 602 may change in color from blue to red to provide a visual cue to the player that the example game described herein is transitioning from the collection game mode to the bonus game mode.

In FIG. 6, spin result 600 includes a trigger symbol 604 displayed in initial game play area 402. The appearance of the trigger symbol 604 satisfies the trigger condition, and a first inactive symbol display position 606 is unlocked. In an example embodiment, unlocked, inactive symbol display positions 606 is configured to also display the trigger symbol 604, thereby providing a visual indication to the player of the number and location of unlocked, inactive symbol display positions. The trigger symbol 604 may appear in the unlocked, inactive symbol display position 606 as an animation. In some embodiments, when a trigger symbol 604 appears in initial game play area 402, the trigger symbol 604 may temporarily change in color and/or size or light up. In an example embodiment, inactive symbol display positions 420 are unlocked according to the corresponding reel 408-416 in which trigger symbol 604 appears in.

As shown in FIG. 6, because trigger symbol 604 appears in second reel 410 in the initial game play area 402, gaming device 200 is configured to unlock one inactive symbol display position associated with second reel 410 in bonus region 404. In various embodiments, two or more inactive symbol display positions 420 may be unlocked in response to the appearance of trigger symbol 604 in initial game play area 402. In an example embodiment, inactive symbol display positions 420 located closest to the initial game play area 402 are unlocked first to "build" or "grow" an associated reel from three symbol display positions (shown in initial game play area 402) to up to eight symbol display positions (which includes three active symbol display positions 418 of initial game play area 402 as well as five inactive symbol display positions 420 of bonus region 404). In some embodiments, inactive symbol display positions 420 are randomly unlocked irrespective of its proximity to initial game play area 402. In some embodiments, inactive symbol display positions 420 are unlocked irrespective of the reel in which the trigger symbol 604 appears in the initial game play area 402. For example, in these embodiments, the appearance of trigger symbol 604 in second reel 410 may prompt gaming device 200 to randomly unlock an inactive symbol display position 420 associated with third reel 412 or fourth reel 414.

In FIG. 6, the appearance of trigger symbol 604 in second reel 410 causes second reel 410 to grow from three symbol display positions to four symbol display positions. Of the four symbol display positions of second reel 410, three symbol display positions in initial game play area 402 are active, and one inactive symbol display position (first unlocked, inactive symbol display position 606) in bonus region 404 is unlocked, but inactive for gameplay during the collection game mode. First reel 408, third reel 412, fourth reel 414, and fifth reel 416 remain unchanged with each reel 408, 412, 414, and 416 including three active symbol positions 418 (as shown in initial game play area 402). In an example embodiment, the symbols displayed in initial game play area 402 are evaluated for purposes of Reel Power evaluation to determine whether an award of credits and/or cash value is to be assigned to the player based on the first round of gameplay.

Figure 7:
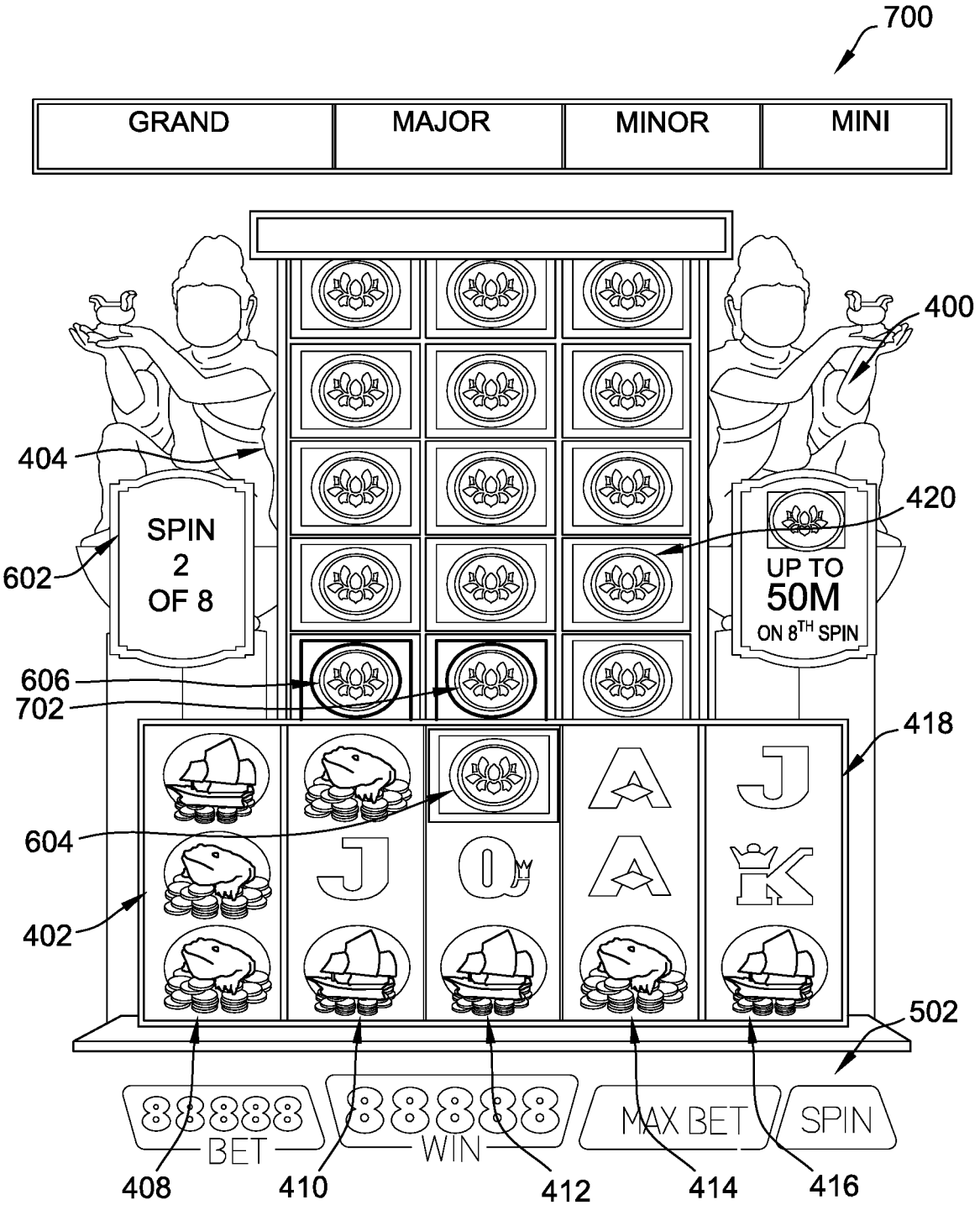
FIG. 7 illustrates an example screenshot of a second collection round of gameplay of the example game.

FIG. 7 illustrates an example spin result 700 on play area 400 after a second round of gameplay. In particular, FIG. 7 illustrates an example in which symbols have been selected, responsive to the player initiating the second collection round by pressing spin button 502. Spin indicator 602 displays the current round of gameplay, as "Spin 2 of 8". Spin result 700 includes a trigger symbol 604 displayed in initial game play area 402. The appearance of the trigger symbol 604 in third reel 412 causes a second inactive symbol display position 702 associated with third reel 412 to unlock. As shown in FIG. 7, a trigger symbol 604 is displayed in the second unlocked, inactive symbol display position 702 to indicate that second inactive symbol display position 702 is unlocked.

Thus, like second reel 410 during the first round of gameplay (see FIG. 6), the appearance of trigger symbol 604 in third reel 412 causes third reel 412 to also grow from three symbol positions to four symbol positions. The four symbol display positions of third reel 412 include three active symbol display positions 418 in initial game play area 402 and one unlocked symbol display position in bonus region 404 (second inactive symbol display position 702). Accordingly, over the two rounds of gameplay, the player has collected a total of two unlocked inactive symbol display positions 606 and 702. In an example embodiment, the symbols displayed in initial game play area 402 are evaluated for purposes of Reel Power evaluation to determine whether an award of credits and/or cash value is to be assigned to the player based on the second round of gameplay.

Figure 8:
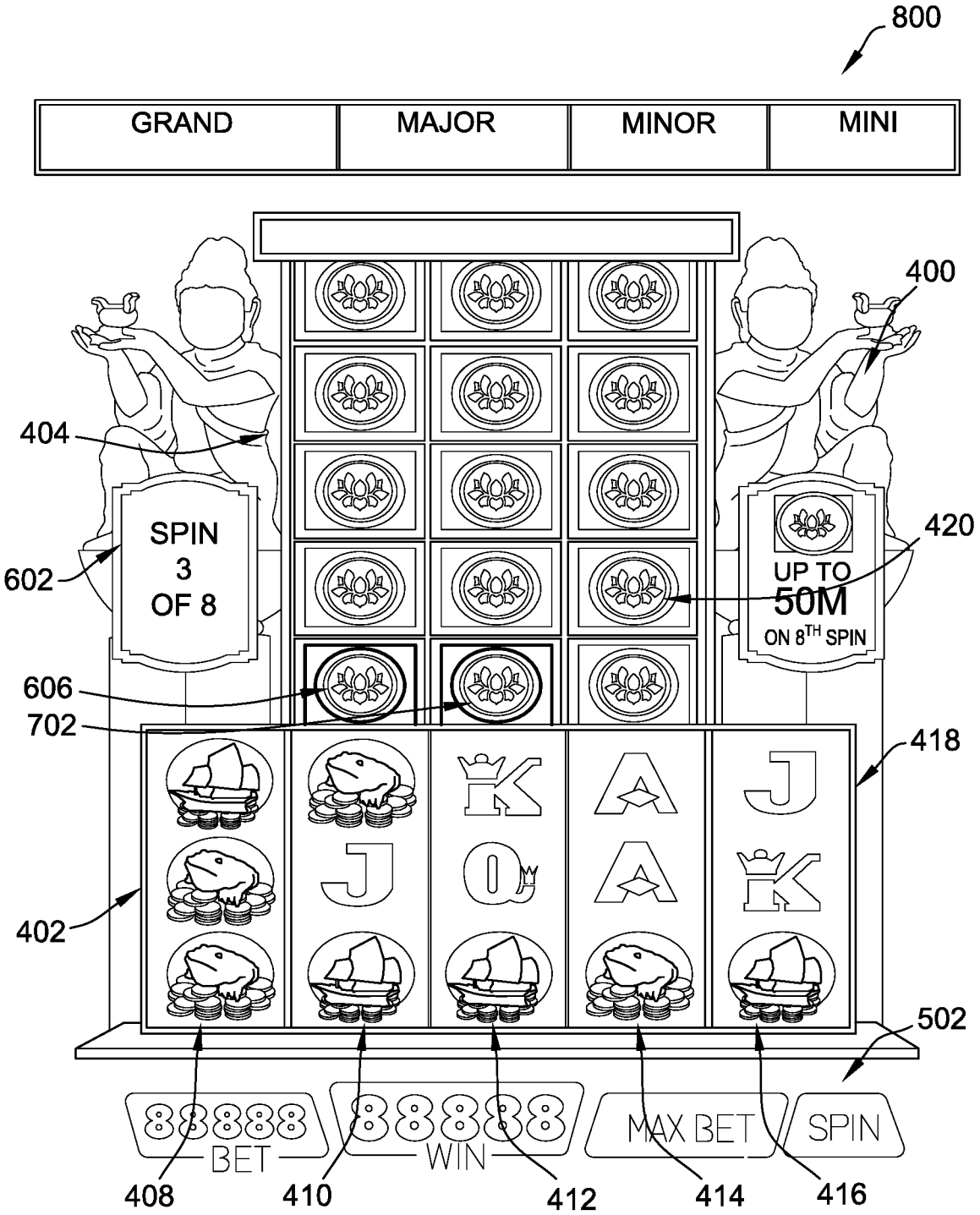
FIG. 8 illustrates an example screenshot of a third collection round of gameplay of the example game.

FIG. 8 illustrates an example spin result 800 on play area 400 after a third consecutive round of gameplay. In particular, FIG. 8 illustrates an example in which symbols have been selected, responsive to the player initiating the third collection round by pressing spin button 502. Spin indicator 602 displays the current round of gameplay, as "Spin 3 of 8". Spin result 800 does not include a trigger symbol 604 in initial game play area 402. Accordingly, no additional inactive symbol display positions 420 are unlocked during this third round of gameplay. Thus, over the three rounds of gameplay, the player has collected a total of two unlocked inactive symbol display positions 606 and 702. Additionally, gaming device 200 evaluates the game outcome of the third collection round to determine whether an award of credits and/or cash value is to be made based on the symbols displayed in initial game play area 402.

Figure 9:
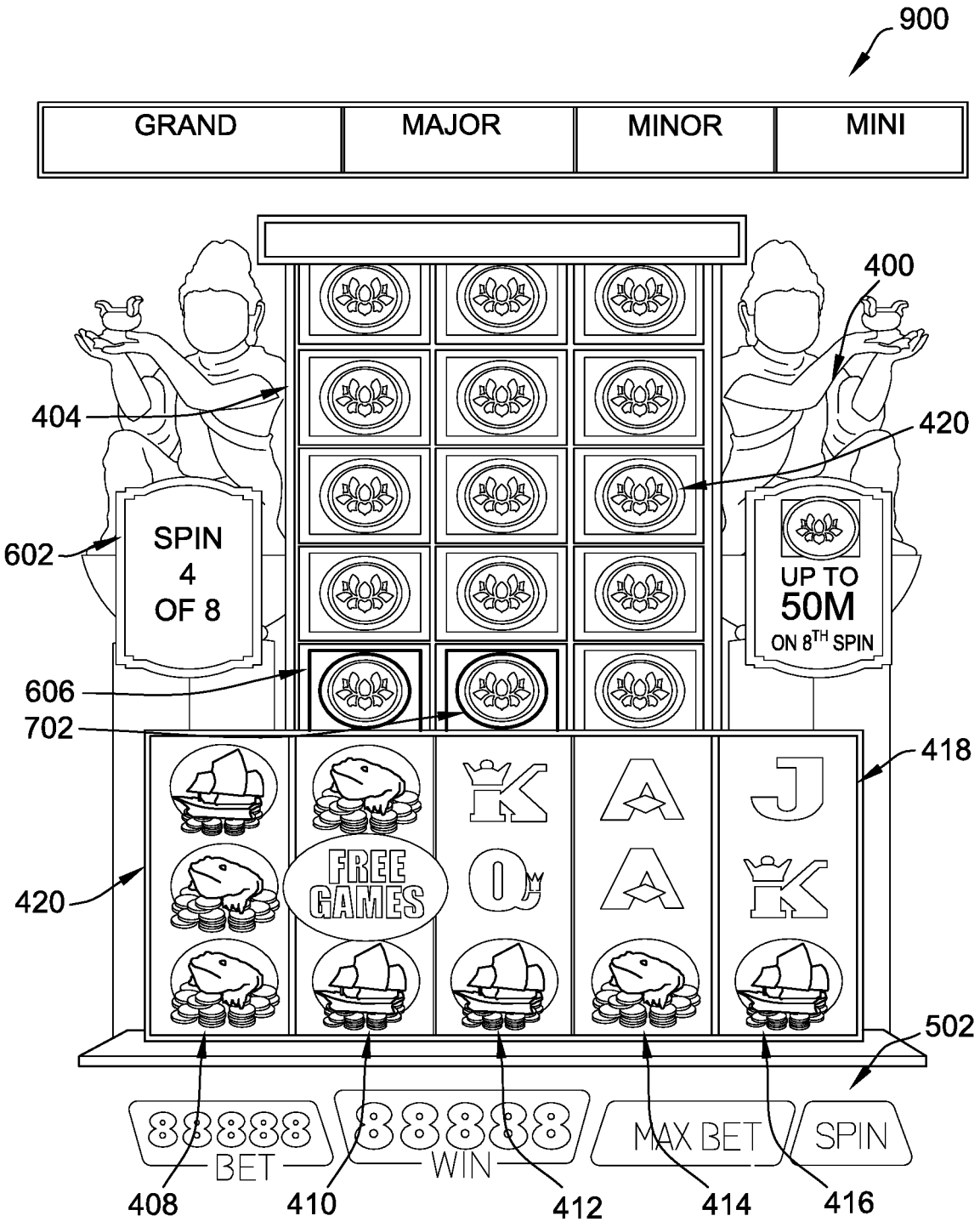
FIG. 9 illustrates an example screenshot of a fourth collection round of gameplay of the example game.

FIG. 9 illustrates an example spin result 900 on play area 400 after a fourth consecutive round of gameplay. In particular, FIG. 9 illustrates an example in which symbols have been selected, responsive to the player initiating the fourth collection round by pressing spin button 502. Spin indicator 602 displays the current round of gameplay, as "Spin 4 of 8". Spin result 900, like spin result 800 of the previous collection round (shown in FIG. 8), does not include a trigger symbol 604 in initial game play area 402. Accordingly, no additional inactive symbol display positions 420 are unlocked during this third round of gameplay. Thus, over the four rounds of gameplay, the player has collected a total of two unlocked inactive symbol display positions 606 and 702. The symbols displayed in initial game play area 402 are evaluated for purposes of Reel Power evaluation to determine whether an award of credits and/or cash value is to be assigned to the player based on the fourth round of gameplay.

Figure 10:
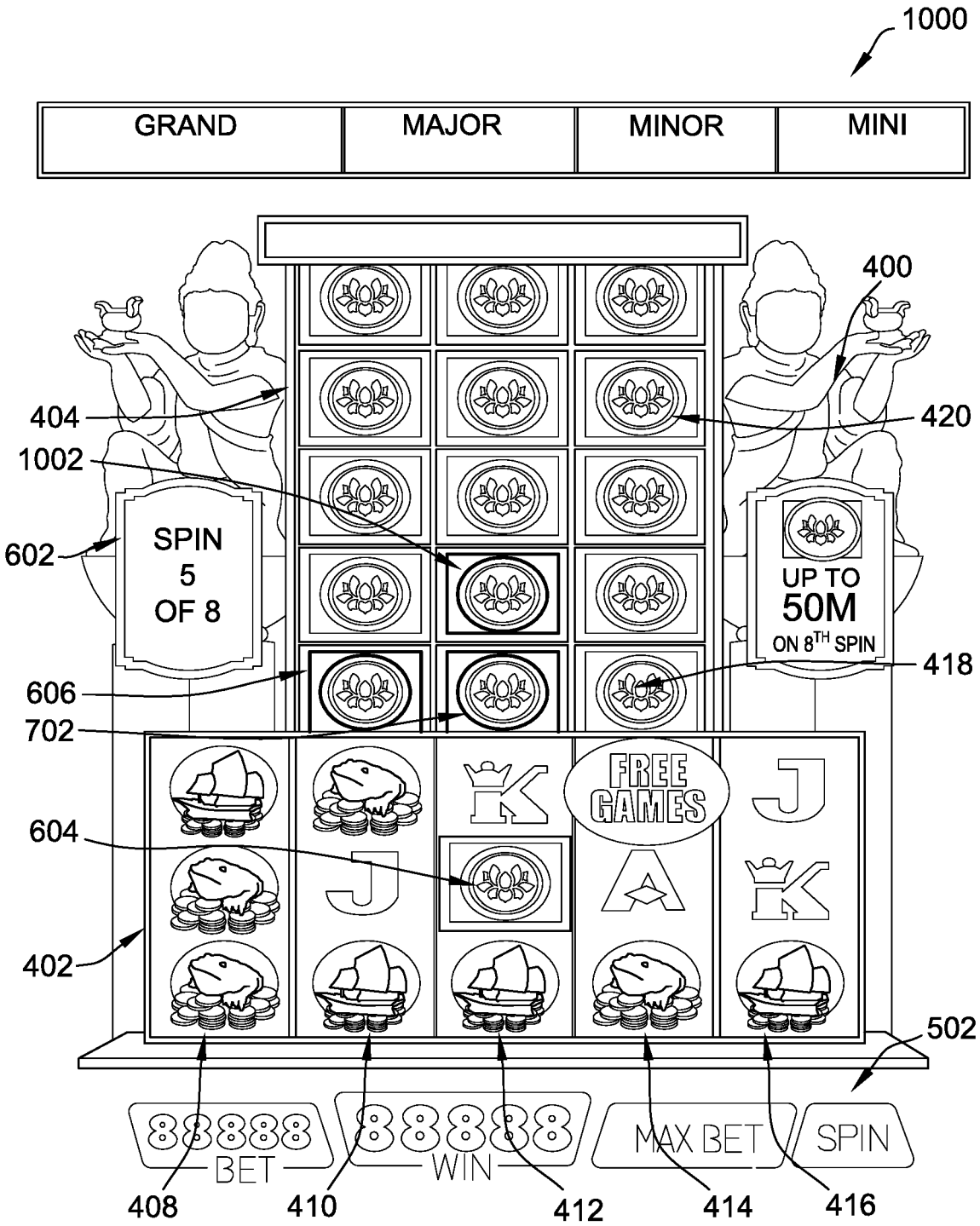
FIG. 10 illustrates an example screenshot of a fifth collection round of gameplay of the example game.

FIG. 10 illustrates an example spin result 1000 on play area 400 after a fifth consecutive round of gameplay. In particular, FIG. 10 illustrates an example in which symbols have been selected, responsive to the player initiating the fifth collection round by pressing spin button 502. Spin indicator 602 displays the current round of gameplay, as "Spin 5 of 8". Spin result 1000 includes a trigger symbol 604 displayed in initial game play area 402. The appearance of the trigger symbol 604 in third reel 412 causes a third inactive symbol display position 1002 associated with third reel 412 to unlock, such that third reel 412 grows from four symbol positions to five symbol positions. In an example embodiment, gaming device 200 is configured to unlock contiguous inactive symbol display positions 420 on a single reel of the plurality of reels over the plurality of collection rounds such that during the bonus game mode, the portion of the single reel visible to the player is extended. Accordingly, the five symbol positions of third reel 412 include three active symbol display positions 418 in initial game play area 402, and two unlocked, inactive symbol display positions 606, 1002 in bonus region 404. Specifically, inactive symbol display position 606 is unlocked in a third spin (shown in FIG. 8), and inactive symbol display position 1002 is unlocked in a subsequent spin (in a fifth spin, shown in FIG. 10) that is contiguous to inactive symbol display position 606. In alternative embodiments, instead of unlocking an additional symbol display position above inactive symbol display position 606, an inactive symbol display position adjacent to inactive symbol display position 606 (e.g., on the right side instead of above) may be unlocked.

In some embodiments, an inactive symbol display position 420 associated with a different reel, such as second reel 410 or fourth reel 414, may be unlocked instead of an inactive symbol display position 420 associated with third reel 412. As shown in FIG. 10, a trigger symbol 604 is displayed in the third inactive symbol display position 1002 to indicate that third inactive symbol display position 1002 is unlocked. Accordingly, over the five collection rounds of gameplay, the player has accumulated a total of three unlocked inactive symbol display positions 606, 702, and 1002. The symbols displayed in initial game play area 402 are are evaluated for purposes of Reel Power evaluation to determine whether an award of credits and/or cash value is to be assigned to the player based on the fifth round of gameplay.

FIG. 11 illustrates an example spin result 1100 on play area 400 after a sixth consecutive round of gameplay. In particular, FIG. 11 illustrates an example in which symbols have been selected, responsive to the player initiating the sixth collection round by pressing spin button 502. Spin indicator 602 displays the current round of gameplay, as "Spin 6 of 8". Spin result 1000 includes a trigger symbol 604 displayed in initial game play area 402. The appearance of the trigger symbol 604 in fourth reel 414 causes a fourth inactive symbol display position 1102 associated with fourth reel 414 to unlock, such that fourth reel 414 grows from three symbol positions to four symbol positions. The four symbol positions of fourth reel 414 include three active symbol display positions 418 in initial game play area 402, and one unlocked, inactive symbol display position 1102 in bonus region 404.

As shown in FIG. 11, a trigger symbol 604 is displayed in the fourth inactive symbol display position 1102 to indicate that fourth inactive symbol display position 1102 is unlocked. Accordingly, over the six collection rounds of gameplay, the player has accumulated a total of four unlocked inactive symbol display positions 606, 702, 1002, and 1102. The symbols displayed in initial game play area 402 are evaluated for purposes of Reel Power evaluation to determine whether an award of credits and/or cash value is to be assigned to the player based on the sixth round of gameplay.

FIG. 12 illustrates an example spin result 1200 on play area 400 after a seventh consecutive round of gameplay. In particular, FIG. 12 illustrates an example in which symbols have been selected, responsive to the player initiating the seventh collection round by pressing spin button 502. Spin indicator 602 displays the current round of gameplay, as "Spin 7 of 8". Spin result 1200, like spin results 800 and 900 of previous collection rounds (shown in FIGS. 8 and 9), does not include a trigger symbol 604 in initial game play area 402. Accordingly, no additional inactive symbol display positions 420 are unlocked during this seventh round of gameplay. Thus, over the seven collection rounds of gameplay, the player has accumulated a total of four unlocked inactive symbol display positions 606, 702, 1002, and 1102. The symbols displayed in initial game play area 402 are evaluated for purposes of Reel Power evaluation to determine whether an award of credits and/or cash value is to be assigned to the player based on the seventh round of gameplay.

FIG. 13 illustrates an example spin result 1300 during a bonus round of gameplay in the bonus game mode. As shown by spin indicator 602 (which displays "$8^{th}$ spin"), the bonus round of gameplay is the eighth round of gameplay. In an example embodiment, the bonus game mode includes one bonus round of gameplay. However, any suitable number of bonus rounds may be implemented on a variety of embodiments. During the bonus round, the unlocked, inactive symbol display positions 606, 702, 1002, and 1102 accumulated in the collection game mode (e.g., throughout the previous seven rounds of gameplay) are activated and become active symbol display positions, like those of initial game play area 402. In various embodiments, the bonus rounds require a wager amount to play.

Accordingly, as shown in FIG. 13, first reel 408 includes three active symbol display positions, second reel 410 includes four active symbol display positions, third reel 412 includes five active symbol display positions, fourth reel 414 includes four active symbol display positions, and fifth reel 416 includes three active symbol display positions. In particular, the portion of reels 410, 412, and 414 that is visible to the player is extended. Each activated symbol display position of bonus region 404 is mapped to a corresponding reel (e.g., reels 410, 412, and 414). Thus, the total number of active symbol display positions 418 available for gameplay in the bonus game mode is nineteen symbol display positions, thereby defining an expanded game play area 1302 of active symbol display positions for gameplay in the bonus game mode. Accordingly, unlike the collection game mode, which enabled the user to utilize fifteen active symbol display positions 418 of the initial game play area 402 during the N-collection rounds (seven previous rounds), the expanded game play area 1302 of nineteen active symbol display positions provides the player more opportunities to win during the M-number of bonus rounds.

FIG. 13 illustrates an example in which symbols have been selected, responsive to the player initiating the eighth round of gameplay (the bonus round) by pressing spin button 502. In an example embodiment, unlocked, inactive symbol display positions 606, 702, 1002, and 1102 (see FIG. 12) become active symbol display positions configured to display symbols. In an example embodiment, gaming device 200 is configured to display one or more mystery symbols 1304 on one or more of second reel 410, third reel 412, and fourth reel 414 during the bonus game mode. Mystery symbols 1304, which may be referred to herein as cash-on-reel symbols, are associated with cash values or jackpot prizes. In an example embodiment, mystery symbols 1304 do not appear during the N-number of collection rounds, but instead are configured to appear on expanded game play area 1302 during the M-number of bonus rounds. In an example embodiment, the expanded game play area 1302 is specific to the bonus game mode. In this example embodiment, reels 408-416 are used to select and display symbols for the expanded game play area 1302. In certain embodiments, reel strips used for reels 408-416 are the same for both the collection rounds as well as the bonus rounds. In certain embodiments, different reels strips are used for the collection rounds and the bonus rounds. The different reels strips used for the bonus rounds may have the mystery symbols in various positions on the reels. In certain embodiments, each symbol display position available (i.e., unlocked) may be associated with an individual reel. As shown in FIG. 13, the example spin result 1300 for one bonus round includes two mystery symbols 1304 that are each associated with a displayed cash value. The symbols displayed in the expanded game play area 1302 of active symbol display positions are evaluated for purposes of Reel Power evaluation. Accordingly, during the M-number of bonus rounds, the player is awarded any cash value associated with one or more displayed mystery symbols 1304 in addition to any Reel Power wins. In various embodiments, mystery symbols 1304 first appear without any values. After the reels stop spinning, the mystery symbols reveal their associated values. In certain embodiments, a payline evaluation may be used instead of Reel Power evaluation. However, in evaluating the payout associated with the displayed mystery symbols 1304, no payline or Reel Power evaluation is needed, since the payout is based on the values associated with those symbols. In certain embodiments, a multiplier value may be used in connection with the mystery symbols 1304.

In certain embodiments, during the play of the collection round, a free spin bonus game may be initiated. The trigger of the free spin bonus game may be symbol based, random, predetermined, centrally determined, etc. The free spin bonus game may be initiated with an initial quantity of spins and may be retriggered (or additional spins provided), if a certain retrigger condition is met. During the play of the free spin bonus game, any occurrence of a trigger symbol in any outcome for any spin, such as trigger symbol 604 in the game play area 402 may unlock one or more inactive symbol positions 420 for the remainder of the free spin bonus game. Further, mystery symbols 1304 may be included in the reel strips used to play the free spin bonus game. The payout for each spin may be based on a payline or Reel Power evaluation of the symbols in the outcome in addition to the payout based on the values of the mystery symbols in that outcome.

In certain embodiments, when the free spin bonus game is initiated, any inactive symbol positions 420 unlocked during play of the collection round may remain unlocked for the free spin bonus game. In certain embodiments, any unlocked inactive symbol positions may become inactive at the start of the free spin bonus game. In certain embodiments, at the end of the free spin bonus game, game play resumes at the collection round. For example, if the free spin bonus game was triggered after play of 4 games in the collection round, play resumes with the $5^{th}$ game in the collection round. In certain embodiments, game play resumes from the start of the collection round. In certain embodiments, inactive symbol positions unlocked during the play of the free spin bonus game remain unlocked at the end of the free spin bonus game for play to continue with the collection round.

In certain embodiments, the collection round does not have a fixed number of spins N. Instead, the collection round continues till a threshold number of inactive symbol positions are unlocked (e.g., all inactive symbol positions being unlocked), and then the bonus round begins.

Figure 14A:
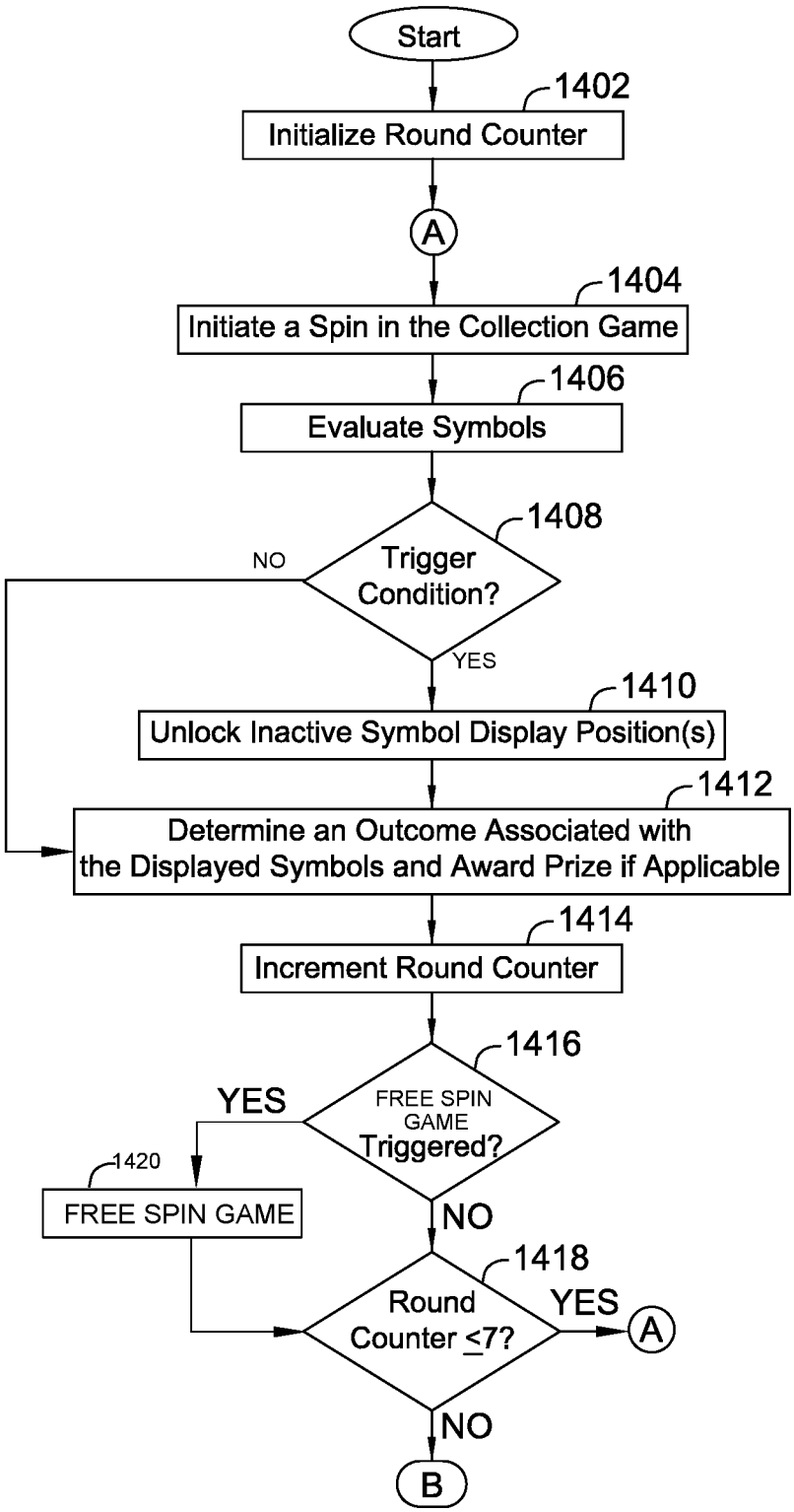
FIGS. 14A and 14B are a flow chart illustrating an example process for short term persistence by unlocking additional symbol positions during an example game as described herein.
Figure 14B:
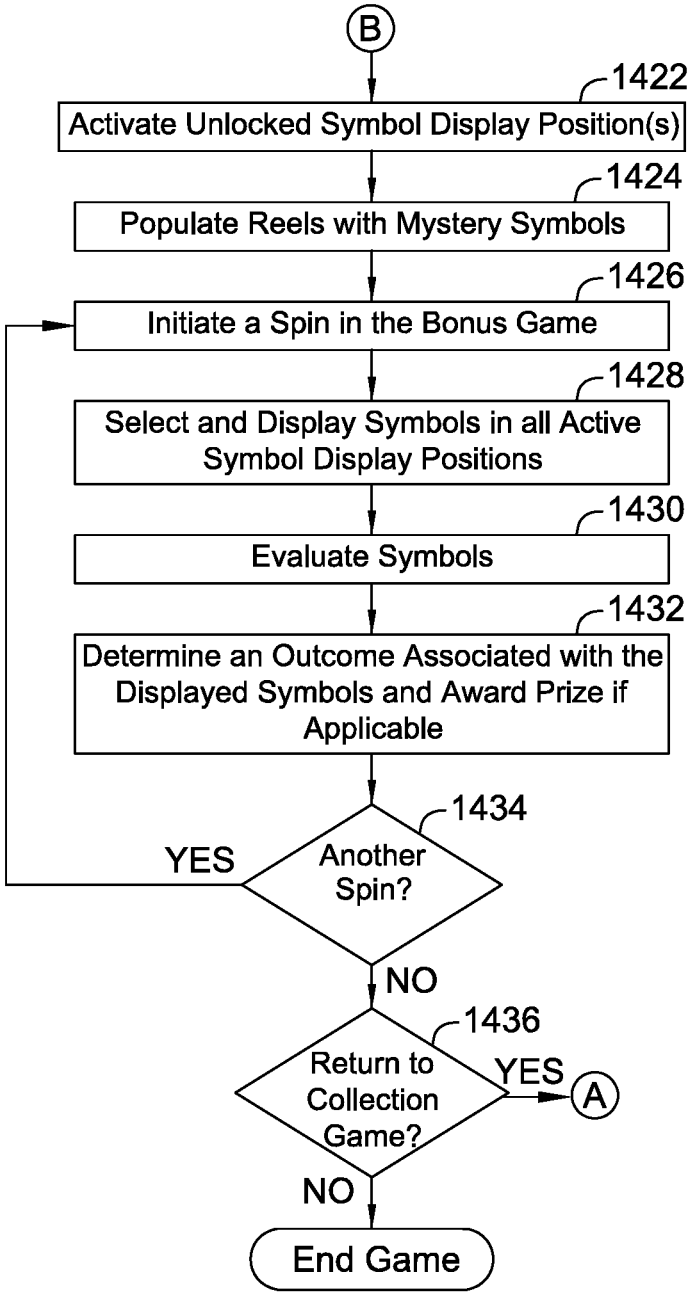

FIGS. 14A and 14B, as described below, are a flow chart 1400 of an example method for short term persistence by unlocking additional symbol positions during a wagering game, such as, for example, any of the wagering games described herein and/or during any other suitable wagering game. In an example embodiment, the method is performed by an EGM such as a gaming device 200 using the initial game play area 402, bonus region 404, and reels 408-416 as described above with respect to FIGS. 4-13. In some embodiments, one or more of the operations of this method may be performed by a backend server (e.g., server systems 108, 110, 112, 114, or the like). In FIG. 14A, the method begins with initiating gameplay (e.g., upon submission of a wager by a player and/or input received from an input interface). At operation 1402, gaming device 200 initializes a round counter. At operation 1404, gaming device 200 initiates a round of the collection game mode. At operation 1406, gaming device evaluates symbols displayed in initial game play area 402, as described above with respect to FIG. 6. If, at operation 1408, a trigger condition is met, then gaming device 200 unlocks one or more inactive symbol display positions at operation 1410. The trigger condition may be a specific trigger symbol or a combination of symbols. Gaming device 200 proceeds to determine an outcome associated with the displayed symbols and awards the player a prize (e.g., a determined amount under a payline or Reel Power evaluation) if applicable at operation 1412.

If, at operation 1408, a trigger condition is not met, then gaming device 200 proceeds to operation 1412. At operation 1414, gaming device 200 increments the round counter. In certain embodiments, a free spin game may be initiated during play of the collection game. The trigger of the free spin game may be symbol based, random, predetermined, centrally determined, etc. If, at operation 1416, the free spin game is triggered, then gaming device 200 proceeds to operation 1420 to initiate the free spin game. If the free spin game is not triggered, gaming device 200 checks, at operation 1418, to see if the round counter is less than or equal to 7 at operation 1418.

If, at operation 1418, the round counter is less than or equal to 7, then gaming device 200 returns to operation 1404 to initiate a subsequent spin in the collection game, which may require another wager. If, at operation 1418, the round counter is greater than 7, then gaming device 200 proceeds to operation 1422 to activate the unlocked symbol display positions for gameplay during the bonus game. The bonus game may be triggered when an initial quantity of spins or an appearance of a specific symbol or a combination of symbols. For example, as shown in FIG. 14A, the bonus game may be triggered when seven spins of the collecting game have been completed (e.g., when round counter at operation 1418 equals 8). In flow chart 1400, gaming device 200 checks to see if the round counter is less than or equal to 7 at operation 1418. However, gaming device 200 may check to see if the round counter is less than or equal to any suitable number of rounds at operation 1418.

At operation 1424, gaming device 200 populates the reels (e.g., reels 408-416) with mystery symbols. Mystery symbols and their various features are described above with respect to FIG. 13. At operation 1426, gaming device 200 initiates a spin in the bonus game. Optionally, a wager may be required (not shown). At operation 1428, gaming device 200 selects and displays symbols in all active symbol display positions. At operation 1430, gaming device 200 evaluates the symbols. At operation 1432, gaming device 200 proceeds to determine an outcome associated with the displayed symbols and award a prize if applicable (e.g., a determined payout amount under a payline or Reel Power evaluation in addition to a payout based on the values of the mystery symbols (if any) in that outcome).

If, at operation 1434, gaming device 200 determines to initiate another spin in the bonus game, then gaming device 200 returns to operation 1426 to initiate a subsequent spin in the bonus game. If, at operation 1434, gaming device 200 determines not to initiate another spin in the bonus game, then gaming device 200 determines whether to return to the collection game at operation 1436. If, at operation 1436, gaming device 200 determines to return to the collection game, then gaming device 200 returns to operation 1404 to initiate a spin in the collection game. If, at operation 1436, gaming device 200 determines not to return to the collection game, then the gaming device 200 ends the wagering game.

In some embodiments, a stack of inactive symbol display positions may be unlocked in response to a trigger condition at operation 1408. For example, instead of unlocking a single inactive symbol display position, a stack of two or three inactive symbol display positions may be unlocked. In some embodiments, instead of unlocking one or more inactive symbol display positions per reel (e.g., as a stack), as shown by inactive symbol display positions 702 and 1002 with respect to reel 412 (all shown in FIG. 12), symbol display positions may be unlocked per row of inactive symbol display positions. For example, three symbol display positions in an additional row, such as inactive symbol display positions 606, 702, and 1102 (all shown in FIG. 12) may be unlocked together. In further embodiments, the trigger condition of operation 1408 may be satisfied when a trigger symbol that spans more than one symbol display position appears on the reels of the initial game play area. In other embodiments, the trigger condition may be satisfied when a stack of trigger symbols appear on the reels of the initial game play area. For example, a stack of two or three trigger symbols may be required to satisfy the trigger condition.

With reference to FIGS. 13 and 14B, in some embodiments, at the eighth spin (or tenth spin in another embodiment), the Value symbols (credits and Jackpots) landed in any unlocked positions are awarded. In alternative embodiments, at the eighth spin (or tenth in another embodiment), the Value symbols (credits and Jackpots) landed in any unlocked positions are awarded if that reel is fully unlocked.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming machine comprising:

at least one display device; and a game controller configured to execute instructions stored in a tangible, non-transitory, computer-readable storage medium, which, when executed by the game controller, cause the game controller to at least:

cause display, on the at least one display device, of (i) an initial game play area including a plurality of reels and (ii) a bonus region positioned above the initial game play area, the initial game play area including a plurality of active symbol display positions, and the bonus region including a plurality of inactive symbol display positions;

cause display, on the at least one display device, of a first game outcome for a first base round of a base game based on a first output, the first game outcome including a plurality of symbols on each of the plurality of reels on the initial game play area;

cause display of an animation at at least one of the plurality of inactive symbol display positions in the bonus region displayed on the at least one display device based on the plurality of symbols including a trigger symbol, wherein display of the animation indicates that the at least one of the plurality of inactive symbol display positions is unlocked and will be activated for evaluation during a bonus game, and wherein the animation includes an unlock symbol;

cause the unlock symbol to remain displayed on the at least one display device at the at least one of the plurality of inactive symbol display positions for at least one remaining base round of a plurality of base rounds such that no new symbol is displayed at the at least one of the plurality of inactive symbol display positions during the at least one remaining base round; and after the at least one remaining base round of the plurality of base rounds of the base game, cause display of the initial game play area on the at least one display device to expand to include activated symbol display positions comprising all inactive display positions that have been unlocked, thereby causing display of an expanded game play area for a bonus game on the at least one display device, the expanded game play area comprising the initial game play area and all inactive display positions that have been unlocked.

2. The electronic gaming machine of claim 1, wherein for each subsequent base round of the plurality of base rounds, the instructions further cause the game controller to:

generate a respective game outcome based on a corresponding output, the respective game outcome including a plurality of symbols on each of the plurality of reels for display on the initial game play area on the at least one display device;

determine whether at least one of the displayed symbols for the respective game outcome is the trigger symbol; and in response to determining that the at least one of the displayed symbols is the trigger symbol, unlock one or more additional inactive symbol display positions in the bonus region.

3. The electronic gaming machine of claim 1, wherein a mapping includes each activated symbol display position of the bonus region being mapped to a corresponding reel of the plurality of reels.

4. The electronic gaming machine of claim 3, wherein the instructions further cause the game controller to cause display of the initial game area to expand by causing a corresponding reel for each of the inactive symbol display positions that have been unlocked to expand based on the mapping.

5. The electronic gaming machine of claim 1, wherein the instructions further cause the game controller to restrict the plurality of inactive symbol display positions of the bonus region to a subset of the plurality of reels.

6. The electronic gaming machine of claim 1, wherein the instructions further cause the game controller to:

determine that the trigger symbol is associated with a first reel of the plurality of reels; and select, based on the determination, an inactive symbol display position associated with the first reel.

7. The electronic gaming machine of claim 1, wherein the instructions further cause the game controller to unlock two or more symbol display positions on a single reel at once in response to the trigger symbol.

8. The electronic gaming machine of claim 1, wherein the instructions further cause the game controller to:

execute a plurality of base game rounds; and unlock contiguous inactive symbol display positions on a single reel of the plurality of reels over the plurality of base game rounds.

9. The electronic gaming machine of claim 1, wherein the instructions further cause the game controller to display a prize symbol at one or more active symbol display positions during the bonus game.

10. The electronic gaming machine of claim 9, wherein the prize symbol is restricted to appearing only during the bonus game.

11. The electronic gaming machine of claim 1, wherein, during the bonus game, the instructions further cause the game controller to:

generate a bonus game outcome by selecting and displaying a plurality of symbols on each of the plurality of reels including the active symbol display positions in the expanded game play area;

evaluate the plurality of displayed symbols of the bonus game outcome to identify any symbols or combination of symbols associated with an award; and assign, based on the evaluation, an award associated with the bonus game.

12. The electronic gaming machine of claim 11, wherein the bonus game outcome includes a prize symbol indicating a credit value, the prize symbol being restricted to the bonus game, and wherein the instructions further cause the game controller to assign the credit value as the award.

13. The electronic gaming machine of claim 1, wherein the at least one of the plurality of inactive symbol display positions is a first inactive symbol display position, and wherein subsequent to the first base round of the base game, the instructions further cause the game controller to:

execute a second base round of the base game;

generate a second game outcome for the second base round based on a second output from a random number generator to display a plurality of symbols on each of the plurality of reels;

determine that at least one of the displayed symbols for the second game outcome is the trigger symbol;

unlock, in response to the determination, a second inactive symbol display position adjacent to the first inactive symbol display position; and execute a third base round of the base game, wherein the first inactive symbol display position and the second inactive symbol display position are unavailable for gameplay during the third base round.

14. The electronic gaming machine of claim 1, wherein the instructions further cause the game controller to:

evaluate, using at least one lookup table, the plurality of displayed symbols associated with the first game outcome;

identify, based on the evaluation, an award based upon an identified winning combination of symbols; and assign the identified award.

15. The electronic gaming machine of claim 1, wherein, for each base round of the plurality of base rounds, the instructions further cause the game controller to evaluate a respective game outcome associated with each base round of the plurality of base rounds to identify any symbols or combination of symbols associated with an award.

16. The electronic gaming machine of claim 1, wherein the unlock symbol is the same as the trigger symbol.

17. The electronic gaming machine of claim 1, wherein the plurality of base rounds after which the bonus game is initiated is predetermined.

18. The electronic gaming machine of claim 1, wherein the base game includes seven consecutive base rounds, and wherein the bonus game includes one bonus round.

19. The electronic gaming machine of claim 1, wherein, in response to determining that the at least one of the displayed symbols is the trigger symbol, the instructions further cause the game controller to populate a first inactive symbol display position with the unlock symbol by referencing at least one lookup table associated with the trigger symbol.

20. The electronic gaming machine of claim 1, wherein no symbol position in the bonus region is evaluated for gameplay during the plurality of base rounds.

* * * * *